US011232751B2

(12) United States Patent
Lee

(10) Patent No.: US 11,232,751 B2
(45) **Date of Patent: *Jan. 25, 2022**

(54) DISPLAY DEVICE AND A METHOD OF DRIVING THE SAME

(71) Applicant: Samsung Display Co., Ltd., Yongin-Si (KR)

(72) Inventor: Wook Lee, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/985,536

(22) Filed: Aug. 5, 2020

(65) Prior Publication Data

US 2020/0365088 A1 Nov. 19, 2020

Related U.S. Application Data

(63) Continuation of application No. 16/511,378, filed on Jul. 15, 2019, now Pat. No. 10,755,644.

(30) Foreign Application Priority Data

Jul. 16, 2018 (KR) ..... 10-2018-0082302

(51) Int. Cl.
*G09G 3/3258* (2016.01)
*G09G 3/3275* (2016.01)
*G09G 3/3266* (2016.01)

(52) U.S. Cl.
CPC ..... *G09G 3/3258* (2013.01); *G09G 3/3275* (2013.01); *G09G 3/3266* (2013.01);
(Continued)

(58) Field of Classification Search
CPC .. G09G 3/3233; G09G 3/3266; G09G 3/3291; G09G 2300/0819;
(Continued)

(56) References Cited

U.S. PATENT DOCUMENTS 8,589,100 B2 11/2013 Chaji et al.
2010/0085368 A1 4/2010 Shin et al.
(Continued)

FOREIGN PATENT DOCUMENTS

KR 101450919 B1 3/2011
KR 1020180025512 A 3/2018

OTHER PUBLICATIONS

Extended European Search Report for Application No. 19185782.0-1210 dated Jan. 21, 2020.

*Primary Examiner* — Nelson M Rosario
(74) *Attorney, Agent, or Firm* — Cantor Colburn LLP

(57) ABSTRACT

A display device includes: a pixel circuit including a switching transistor connected to a data line, a storage capacitor connected to the switching transistor, a driving transistor connected to the storage capacitor, an organic light-emitting diode connected to the driving transistor and a sensing transistor connected between a sensing line and the driving transistor; and a data-sensing circuit including a first selector connected to the data line and the sensing line, a second selector connected to an output terminal of an amplifier, he first selector and a feedback capacitor, where the second selector selectively connects the output terminal of the amplifier to the first selector and the feedback capacitor, a third selector connected to the sensing line, and a fourth selector connected to the output terminal of the amplifier and the third selector.

20 Claims, 25 Drawing Sheets

(52) U.S. Cl.
CPC ..... *G09G 2300/0426* (2013.01); *G09G 2300/0439* (2013.01); *G09G 2310/0291* (2013.01)

(58) Field of Classification Search
CPC ... G09G 2300/0842; G09G 2300/0852; G09G 2300/0861; G09G 2310/0243; G09G 2310/08; G09G 2320/0233; G09G 2320/0238; G09G 2330/028
See application file for complete search history.

(56) References Cited

U.S. PATENT DOCUMENTS

| | | | | |
|---|---|---|---|---|
| 2011/0050749 | A1 | 3/2011 | Park | |
| 2017/0039952 | A1 | 2/2017 | Kim | |
| 2017/0287405 | A1* | 10/2017 | Tseng | G09G 3/3275 |
| 2018/0144683 | A1 | 5/2018 | Shin | |

* cited by examiner

<EMISSION PERIOD>

<SENSE INITIALIZATION>

Votage sensing @power off
(VTH Sampling & Hold)

Votage sensing @power off
(ADC)

Current sensing @power off
<Current Sampling & Hold>

Fast Current sensing @display on
<AMP Reset>

Fast Current sensing @display on
<Current Sampling & Hold>

Fast Voltage sensing @display on
<Forming Sensing Voltage>

Fast Voltage sensing @display on
<Forming Swing Voltage>

Fast Voltage sensing @display on
<Initializing Sensing Line>

Fast Voltage sensing @display on
<Voltage Sampling & Hold>

<EMISSION PERIOD>

<SENSE INITIALIZATION>

Votage sensing @power off
(VTH Sampling & Hold)

Votage sensing @power off
(ADC)

Current sensing @power off
<Current Sampling & Hold>

Fast Current sensing @display on
<AMP Reset>

Fast Current sensing @display on
<Current Sampling & Hold>

Fast Voltage sensing @display on
<Forming Sensing Voltage>

Fast Voltage sensing @display on
<Initializing Data Line>

Fast Voltage sensing @display on
<Voltage Sampling & Hold>

DISPLAY DEVICE AND A METHOD OF DRIVING THE SAME

This application is a continuation of U.S. patent application Ser. No. 16/511,378, filed on Jul. 15, 2019, which claims priority to Korean Patent Application No. 10-2018-0082302 filed on Jul. 16, 2018, and all the benefits accruing therefrom under 35 U.S.C. § 119, the content of which in its entirety is herein incorporated by reference.

BACKGROUND

1. Field

Exemplary embodiments of the invention relate to a display device and a method of driving the display device. More particularly, exemplary embodiments of the invention relate to a display device for sensing a degradation of a pixel circuit and a method of driving the display device.

2. Description of the Related Art

An organic light-emitting display is a device that displays images using an organic light-emitting diode ("OLED"). Characteristics of both an OLED and a driving transistor that supplies a current thereto may degrade by being used. The organic light-emitting display may not display images of desired luminance due to the degradation of the OLED or the driving transistor

BRIEF SUMMARY

Methods to compensate for deterioration of the organic light-emitting display may include a voltage-sensing method to compensate for the threshold voltage of the driving transistor and a current-sensing method to compensate by sensing the current flowing to the organic light-emitting diode.

In the voltage-sensing method, tens milliseconds (ms), usually 30 ms, is used to sensing the threshold voltage. For example, in the organic light-emitting display with ultra-high definition ("UM") resolution, a sensing time of between 5 minutes and 10 minutes is desired for the voltage-sensing method. Therefore, the voltage-sensing method may be performed only in power-off or display-off, but real-time compensation may not be effectively performed.

On the other hand, the current-sensing method may reduce the sensing time compared to the voltage-sensing method, but the circuit size may increase as separate amplifiers for sensing are desired.

Exemplary embodiments of the invention provide a display device for performing voltage-sensing and current-sensing of a pixel circuit.

Exemplary embodiments of the invention provide a method of driving the display device.

According to an exemplary embodiment of the invention, a display device includes: a pixel circuit including a switching transistor connected to a data line, a storage capacitor connected to the switching transistor, a driving transistor connected to the storage capacitor, an organic light-emitting diode connected to the driving transistor and a sensing transistor connected between a sensing line and the driving transistor; and a data-sensing circuit including a first selector connected to the data line and the sensing line, a second selector connected to an output terminal of an amplifier, the first selector and a feedback capacitor, where the second selector selectively connects the output terminal of the amplifier to the first selector and the feedback capacitor, a third selector connected to the sensing line, and a fourth selector connected to the output terminal of the amplifier and the third selector.

In an exemplary embodiment, the second selector may include a third switch connected between the output terminal of the amplifier and the feedback capacitor, and a fourth switch connected between the output terminal and a first input terminal of the amplifier.

In an exemplary embodiment, the first selector may include a first switch connected between the data line and the fourth switch and a second switch connected between the sensing line and the fourth switch, and the third selector may include a fifth switch connected between a voltage terminal and the sensing line and a sixth switch connected between the sensing line and the fourth selector.

In an exemplary embodiment, the fourth selector may include a seventh switch connected between the second selector and the sixth switch, and an eighth switch connected between the seventh switch and a capacitor of the data-sensing circuit.

In an exemplary embodiment, a sensing period may include an initializing period, in which the pixel circuit is initialized, and a signal sensing period, in which a sensing signal formed in the pixel circuit is sensed. In such an embodiment, in the initializing period, the switching transistor and the sensing transistor are turned on, the first, third, fourth and fifth switches are turned on, the second, sixth, seventh and eighth switches are turned off, the voltage terminal receives a first reference voltage, a second input terminal of amplifier receives a second reference voltage, the first reference voltage is applied to an electrode of the driving transistor, and the second reference voltage is applied to a control electrode of the driving transistor.

In an exemplary embodiment, the signal sensing period, in which a sensing voltage is sensed from the pixel circuit, may be defined in a power-off period. In such an embodiment, in the signal sensing period, the switching transistor and the sensing transistor are turned on, the first, third, fourth, sixth and eighth switches are turned on, the second, fifth and seventh switches are turned off, and a sensing signal corresponding a threshold voltage of the driving transistor received from the sensing line is stored in the capacitor of the data-sensing circuit.

In an exemplary embodiment, the signal sensing period, in which a sensing current is sensed from the pixel circuit, may be defined in a power-off period. In such an embodiment, in the signal sensing period, the switching transistor is turned off, the sensing transistor is turned on, the sixth and eighth switches are turned on, the first, second, third, fourth, fifth and seventh switches are turned off, and a sensing signal corresponding a current flowing through the driving transistor received from the sensing line is stored in the capacitor of the data-sensing circuit.

In an exemplary embodiment, the signal sensing period, in which a sensing current is sensed from the pixel circuit, may be defined in a display period. In such an embodiment, in the signal sensing period, the switching transistor is turned off, the sensing transistor is turned on, the second, third, fourth, seventh and eighth switches are turned on, the first, fifth and sixth switches are turned off, the second input terminal of the amplifier receives a third reference voltage, a current flows between a driving transistor, which receives a power source voltage, the sensing line connected to the driving transistor, the amplifier connected to the sensing line and a ground connected to the output terminal of the amplifier, and the amplifier and the feedback capacitor are reset.

In an exemplary embodiment, after the amplifier is reset, the switching transistor may be turned off, the sensing transistor may be turned on, the second, third, seventh and eighth switches may be turned on, the first, fourth, fifth and sixth switches may be turned off, a sensing signal corresponding to a current flowing through the driving transistor may be applied to the amplifier and the feedback capacitor, and a voltage outputted from the output terminal of the amplifier may be stored in the capacitor of the data-sensing circuit.

In an exemplary embodiment, the signal sensing period, in which a sensing voltage is sensed from the pixel circuit, may be defined in a display period. In such an embodiment, in the signal sensing period, the switching transistor is turned on, the sensing transistor is turned off, the first, third and fourth switches are turned on, the second, fifth, sixth, seventh and eighth switches are turned off, the second input terminal of the amplifier receives a second reference voltage, the second reference voltage is applied to a control electrode of the driving transistor through the data line, and the sensing voltage corresponding to a threshold voltage of the driving transistor is stored in the storage capacitor.

In an exemplary embodiment, after the sensing voltage is stored in the storage capacitor, the switching transistor may be turned off, the sensing transistor may be turned on, the second, third, fourth, seventh and eighth switches may be turned on, the first, fifth and sixth switches may be turned off, the second input terminal of the amplifier may receive a third reference voltage, the sensing line is connected to a first input terminal of the amplifier, the output terminal of the amplifier is connected to the capacitor of the data-sensing circuit, and the sensing line and the feedback capacitor are initialized through the amplifier.

In an exemplary embodiment, after the sensing line is initialized, the switching transistor and the sensing transistor may be turned on, the second, third, seventh and eighth switches may be turned on, and the first, fourth, fifth and sixth switches may be turned off. In such an embodiment, when the sensing transistor is turned on, the storage capacitor and the feedback capacitor connected to each other through the sensing line may be charge-shared with each other and an output voltage of the amplifier is stored in a capacitor of the data-sensing circuit.

According to an exemplary embodiment of the invention, a display device includes: a pixel circuit including a switching transistor connected to a data line, a storage capacitor connected to the switching transistor, a driving transistor connected to the storage capacitor, an organic light-emitting diode connected to the driving transistor and a sensing transistor connected between the data line and the driving transistor; and a data-sensing circuit including a first selector connected to the data line, a second selector connected to an output terminal of an amplifier, where the second selector selectively connects the output terminal of the amplifier to the first selector and the feedback capacitor, the first selector and a feedback capacitor, a third selector connected to the first selector, and a fourth selector connected to the output terminal of the amplifier and the third selector.

In an exemplary embodiment, the second selector may include a third switch connected between the output terminal of the amplifier and the feedback capacitor, and a fourth switch connected between the output terminal and a first input terminal of the amplifier.

In an exemplary embodiment, the first selector may include a first switch connected between the data line and the fourth switch and a second switch connected between the data line and the third selector, and the third selector may include a fifth switch connected between a voltage terminal and the second switch and a sixth switch connected between the second switch and the fourth selector.

In an exemplary embodiment, the fourth selector may include a seventh switch connected between the second selector and the sixth switch, and an eighth switch connected between the seventh switch and a capacitor of the data-sensing circuit.

In an exemplary embodiment, a sensing period may include an initializing period, in which the pixel circuit is initialized, and a signal sensing period, in which a sensing signal formed in the pixel circuit is sensed. In such an embodiment, in a first period of the initializing period, a second reference voltage is received from a second input terminal of the amplifier, the switching transistor is turned on, the sensing transistor is turned off, the first, third and fourth switches are turned on, the second, fifth, sixth, seventh and eighth switches are turned off, and the second reference voltage is applied to a control electrode of the driving transistor. In such an embodiment, in a second period of the initializing period, a voltage terminal receives a first reference voltage, the switching transistor is turned off, the sensing transistor is turned on, the fifth switch is turned on, the first, second, third, fourth, sixth, seventh and eighth switches are turned off, and an electrode of the driving transistor receives the first reference voltage.

In an exemplary embodiment, the signal sensing period, in which a sensing voltage is sensed from the pixel circuit, may be defined in a power-off period. In such an embodiment, in a first period of the signal sensing period, the second input terminal of the amplifier receives a second reference voltage, the switching transistor is turned on, the sensing transistor is turned off, the first, third and fourth switches are turned on, the second, fifth, sixth, seventh and eighth switches are turned off, and the driving transistor forms a threshold voltage. In such an embodiment, in a second period of the signal sensing period, the switching transistor is turned off, the sensing transistor is turned on, the sixth and eighth switches are turned on, the first, second, third, fourth, fifth and seventh switches are turned off, and a sensing signal corresponding to the threshold voltage of the driving transistor is stored in the capacitor of the data-sensing circuit through the data line.

In an exemplary embodiment, the signal sensing period, in which a sensing current is sensed from the pixel circuit, may be defined in a power-off period. In such an embodiment, in the signal sensing period, the switching transistor is turned off, the sensing transistor is turned on, the sixth and eighth switches are turned on, the first, second, third, fourth, fifth and seventh switches are turned off, and a sensing signal corresponding a current flowing through the driving transistor received from the data line is stored in the capacitor of the data-sensing circuit.

In an exemplary embodiment, the signal sensing period, in which a sensing current is sensed from the pixel circuit, may be defined in a display period. In such an embodiment, in the signal sensing period, the switching transistor is turned off, the sensing transistor is turned on, the first, third, fourth, seventh and eighth switches are turned on, the second, fifth and sixth switches are turned off, the second input terminal of the amplifier receives a third reference voltage, a current flows between a driving transistor, which receives a power source voltage, the data line connected to the driving transistor, the amplifier connected to the data line and a ground connected to the output terminal of the amplifier, and the amplifier and the feedback capacitor are reset.

In an exemplary embodiment, after the amplifier is reset, the switching transistor may be turned off, the sensing transistor may be turned on, the first, third, seventh and eighth switches may be turned on, the second, fourth, fifth and sixth switches may be turned off, a sensing signal corresponding to a current flowing through the driving transistor may be applied to the amplifier and the feedback capacitor, and a voltage outputted from the output terminal of the amplifier may be stored in the capacitor of the data-sensing circuit.

In an exemplary embodiment, the signal sensing period in which a sensing voltage is sensed from the pixel circuit is predetermined in a display period, the switching transistor is turned on, the sensing transistor is turned off, the first, third and fourth switches are turned on, the second, fifth, sixth, seventh and eighth switches are turned off, the second input terminal of the amplifier receives a third reference voltage, the third reference voltage is applied to a control electrode of the driving transistor through the data line, and the sensing voltage corresponding to a threshold voltage of the driving transistor is stored in the storage capacitor.

In an exemplary embodiment, after the sensing voltage corresponding to the threshold voltage is stored, the switching transistor is turned off, the sensing transistor is turned on, the first, third, fourth, seventh and eighth switches are turned on, the second, fifth and sixth switches are turned off, the second input terminal of the amplifier receives a fourth reference voltage, the data line is connected to a first input terminal of the amplifier, the output terminal of the amplifier is connected to the capacitor of the data-sensing circuit, and the data line and the feedback capacitor are initialized through the amplifier.

In an exemplary embodiment, after the data line is initialized, the switching transistor is turned off, the sensing transistor is turned on, the first, third, seventh and eighth switches are turned on and the second, fourth, fifth and sixth switches turned off, wherein when the sensing transistor is turned on, the storage capacitor and the feedback capacitor connected to each other through the data line are charge-shared with each other and an output voltage of the amplifier is stored in the capacitor of the data-sensing circuit.

According to an exemplary embodiment of the invention, a method of driving a display device which includes: a pixel circuit including an organic light-emitting diode; and a data-sensing circuit comprising a first selector connected to a data line of the pixel circuit and a sensing line, a second selector connected to an output terminal of an amplifier, the first selector and a feedback capacitor, a third selector connected to the sensing line, and a fourth selector connected to the output terminal of the amplifier and the third selector, the method including initializing the pixel circuit, where the initializing the pixel circuit includes transferring a first reference voltage to the sensing line through the third selector, turning on a sensing transistor of the pixel circuit, which is connected to the sensing line in the pixel circuit, such that the first reference voltage is applied to the pixel circuit, transferring a second reference voltage received from an amplifier of the data-sensing circuit to the data line through the first selector, and turning on a switching transistor of the pixel circuit, which is connected to the data line in the pixel circuit, such that the second reference voltage is applied to the pixel circuit.

In an exemplary embodiment, the method may further includes sensing a sensing voltage formed in the pixel circuit in a power-off period, where the sensing the sensing voltage in the power-off period may include transferring a reference voltage received from the amplifier to the data line through the first selector and the second selector, turning on the switching transistor connected to the data line in the pixel circuit such that reference voltage is applied to the pixel circuit, and storing the sensing voltage of the pixel circuit transferred from the sensing line by the third selector and the fourth selector in a capacitor.

In an exemplary embodiment, the method may further includes sensing a sensing current formed in the pixel circuit in a power-off period, where the sensing the sensing current in the power-off period may include turning off the switching transistor, turning on the sensing transistor, and storing the sensing current of the pixel circuit transferred from the sensing line by the third selector and the fourth selector in a capacitor of the data-sensing circuit.

In an exemplary embodiment, the method may further includes initializing an amplifier in a display period, where the initializing the amplifier in the display period may include turning on the sensing transistor, connecting the sensing line to an amplifier by the first selector, where an input terminal and an output terminal of the amplifier are connected to each other by the second selector, connecting the output terminal of the amplifier to a capacitor of the data-sensing circuit by the fourth selector, where the capacitor is connected to a ground, and flowing a current between the driving transistor, which receives a power source voltage, the sensing line connected to the driving transistor, the amplifier connected to the sensing line and a ground connected to the output terminal of the amplifier such that the amplifier and the feedback capacitor are reset.

In an exemplary embodiment, the method may further includes sensing a sensing current formed in the pixel circuit in the display period, where the sensing the sensing current in the display period may include turning on the sensing transistor, connecting the sensing line to an amplifier by the first selector, where an input terminal and an output terminal of the amplifier are connected to each other through the feedback capacitor by the second selector, connecting the output terminal of the amplifier to a capacitor of the data-sensing circuit by the fourth selector, and storing the sensing current flowing through the driving transistor to the capacitor by the amplifier and the feedback capacitor.

In an exemplary embodiment, the method may further includes sensing a sensing voltage of the pixel circuit in the display period, where the sensing the sensing voltage in the display period may include turning on the sensing transistor, connecting the sensing line to an amplifier by the first selector, where an input terminal and an output terminal of the amplifier are connected to each other through the feedback capacitor by the second selector, and connecting the output terminal of the amplifier to a capacitor of the data-sensing circuit by the fourth selector. In such an embodiment, when the sensing transistor is turned on, the storage capacitor and the feedback capacitor connected to each other through the sensing line may be charge-shared with each other and an output voltage of the amplifier may be stored in the capacitor of the data-sensing circuit.

According to exemplary embodiments of the invention, the data-sensing driver may be simplified, senses the sensing voltage and the sensing current from the pixel circuit in the power-off period or in the display period. In such embodiments, in the display period, the sensing voltage from the pixel circuit may quickly sense by charge-sharing of the storage capacitor and the feedback capacitor.

BRIEF DESCRIPTION OF THE DRAWINGS

The above and other features of the invention will become more apparent by describing in detailed exemplary embodiments thereof with reference to the accompanying drawings, in which.

DETAILED DESCRIPTION

Figure 1:
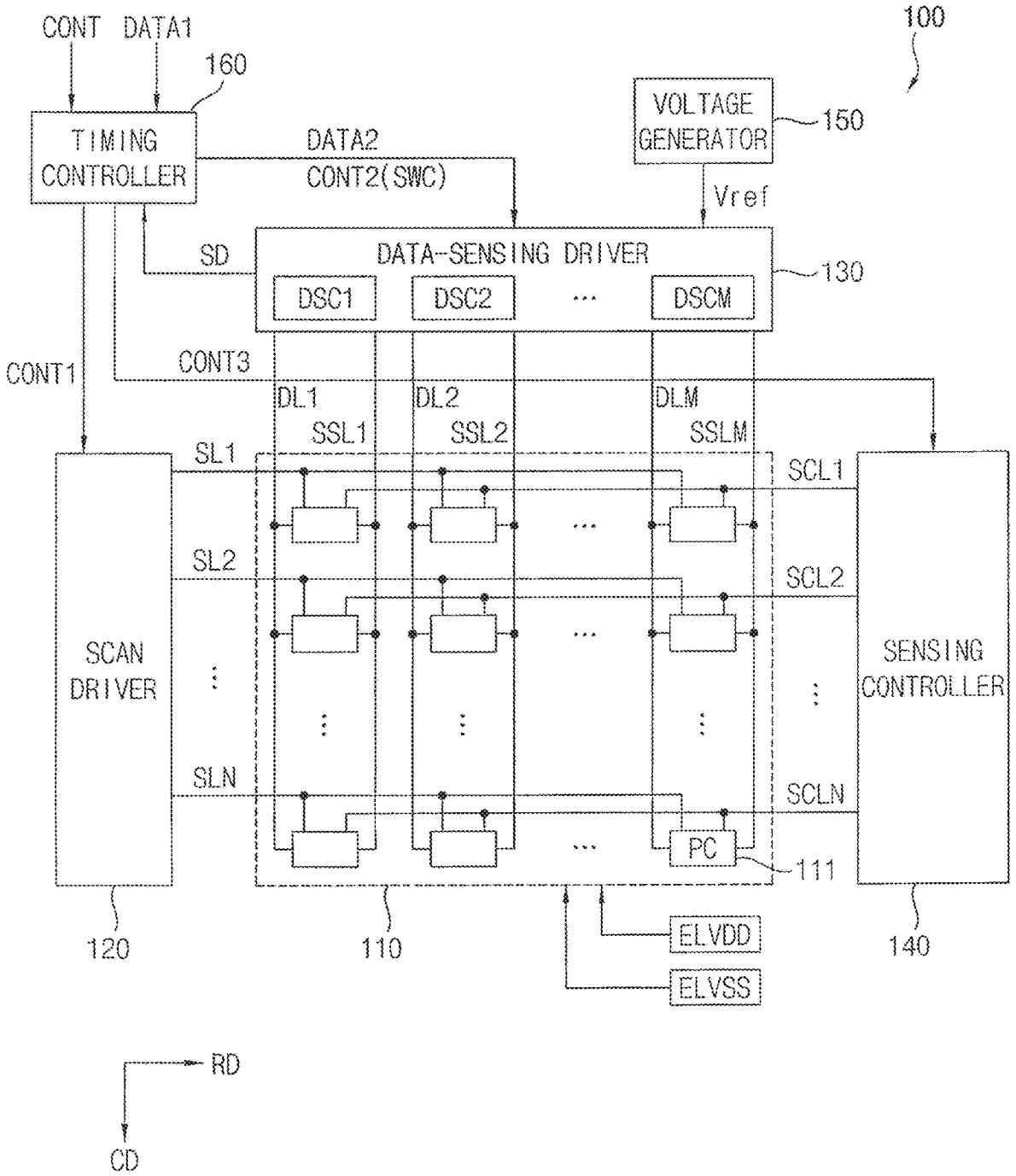
FIG. 1 is a block diagram illustrating an organic light-emitting display device according to an exemplary embodiment.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "connected to" another element, it can be directly connected to the other element or intervening elements may be present therebetween. In contrast, when an element is referred to as being "directly connected to" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. "At least one of A and B" means "A or B." It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, exemplary embodiments of the invention will be described in detail with reference to the accompanying drawings.

Figure 2:
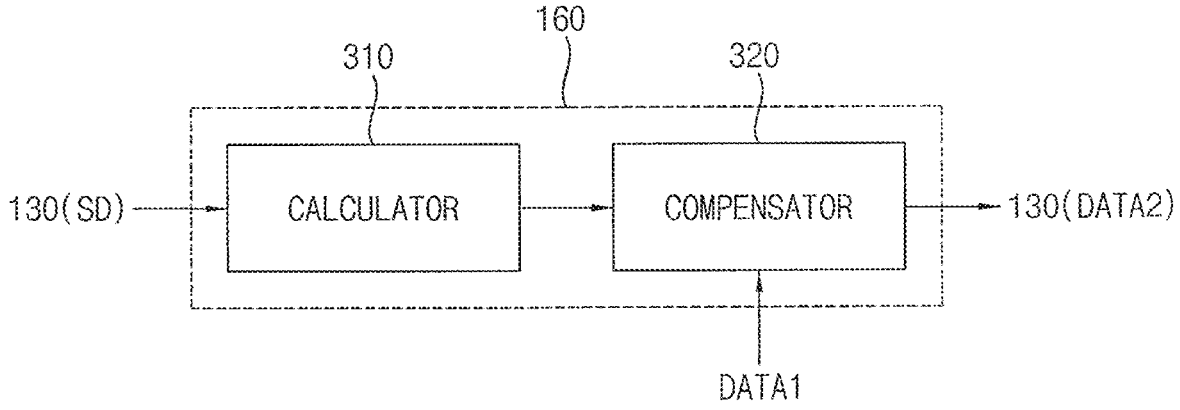
FIG. 2 is a block diagram illustrating a timing controller according to an exemplary embodiment.
Figure 3:
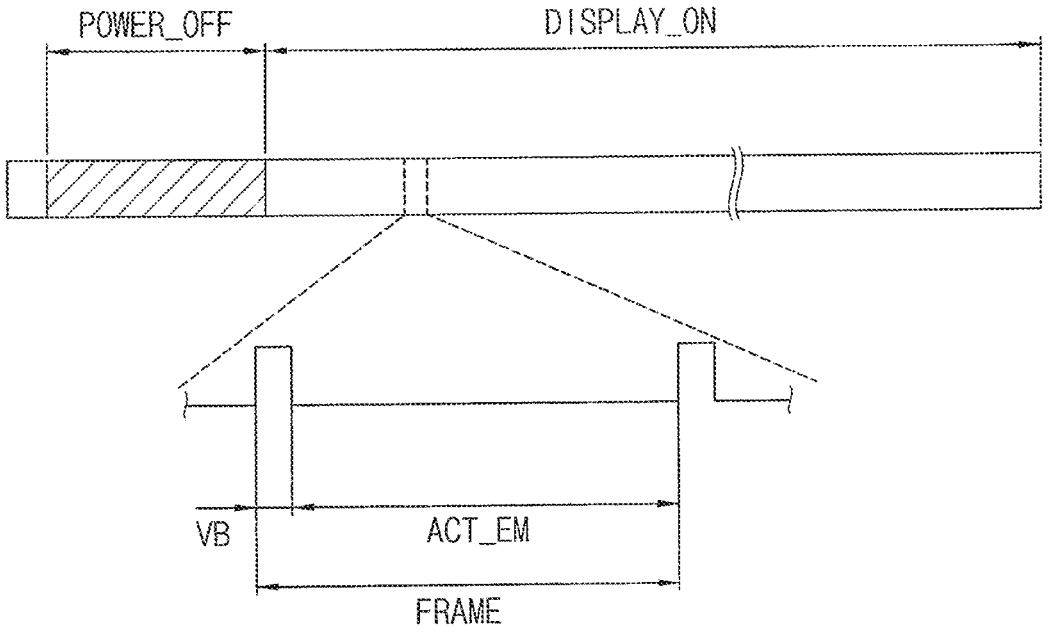
FIG. 3 is a conceptual diagram illustrating driving periods of an organic light-emitting display device according to an exemplary embodiment.

FIG. 1 is a block diagram illustrating an organic light-emitting display device according to an exemplary embodiment. FIG. 2 is a block diagram illustrating a timing controller according to an exemplary embodiment. FIG. 3 is a conceptual diagram illustrating driving periods of an organic light-emitting display device according to an exemplary embodiment.

Referring to FIG. 1, an exemplary embodiment of the organic light-emitting display device 100 may include a display panel 110, a scan driver 120, a data-sensing driver 130, a sensing controller 140, a voltage generator 150 and a timing controller 160.

The display panel 110 may include a plurality of scan lines SL1, SL2 to SLN, a plurality of data lines DL1, DL2 to DLM, a plurality of sensing control lines SCL1, SCL2 to SCLN, a plurality of sensing lines SSL1, SSL2 to SSLM and a plurality of pixels 111. Here, 'N' and 'M' are natural number that is equal to or more than 2.

The plurality of pixels 111 is arranged in a matrix form which includes a plurality of pixel rows and a plurality of pixel columns. A pixel row may extend in a row direction RD and a pixel column may extend in a column direction CD.

Each pixel 111 may include a pixel circuit PC. A pixel circuit PC may include a plurality of transistors, which is connected to a scan line, a data line, a sensing control line and a sensing line, and an organic light-emitting diode which is connected to the transistors. The pixel circuit PC stores a data voltage in response to a scan signal and emits a light of a grayscale corresponding to the data voltage. The pixel circuit PC will be described later in greater detail referring to FIG. 4.

The scan driver 120 is configured to generate a plurality of scan signals based on a first control signal CONT1 provided from the timing controller 160. The scan driver 120 is configured to sequentially generate a plurality of scan signals.

The data-sensing driver 130 may include a plurality of data-sensing circuits DSC1, DSC2 to DSCM, which is connected to a plurality of data lines DL1, DL2 to DLM and a plurality of sensing lines SSL1, SSL2 to SSLM.

In an exemplary embodiment, a data-sensing circuit is configured to output a data voltage to a data line in an emission period, in which the organic light-emitting diode in the pixel circuit emits the light to display an image, and to readout a sensing signal through a sensing line in a sensing period, in which a degradation of the pixel circuit is sensed. The data-sensing circuit may include an amplifier. The amplifier may function as an output buffer in the emission period and is used to readout the sensing signal in the sensing period.

The data-sensing driver 130 is configured to convert compensation image data DATA2 to a data voltage based on a second control signal CONT2 provided from the timing controller 160, to amplify the data voltage and to output the data voltage to the data line in the emission period.

In such an embodiment, the data-sensing driver 130 is configured to convert the sensing signal received from the pixel circuit PC to sensing data SD based on a second control signal CONT2 in the sensing period and to output the sensing data SD to the timing controller 160. The second control signal CONT2 may include a plurality of switch control signals SWC for controlling a plurality of switches in the data-sensing circuit.

According to an exemplary embodiment, the data-sensing circuit may be simplified by sharing the amplifier in the emission period and the sensing period. The data-sensing circuit will be described later in greater detail referring to FIG. 4.

The sensing controller 140 is configured to generate a plurality of sensing control signals based on a third control signal CONT3 provided from the timing controller 160. The sensing controller 140 may sequentially provide the plurality of sensing control lines SCL1, SCL2 and SCLN with the plurality of sensing control signals. Alternatively, the sensing controller 140 may provide partial sensing control lines among the all sensing control lines SCL1, SCL2 and SCLN with the sensing control signals.

In such an embodiment, the plurality of sensing control lines SCL1, SCL2 to SCLN is connected to the scan driver 120, and the scan driver 120 may generate a plurality of sensing control signals (not shown) to be applied to the plurality of sensing control lines SCL1, SCL2 to SCLN.

The voltage generator 150 is configured to generate a plurality of driving voltages for driving the organic light-emitting display device 100. The plurality of driving voltages may include a plurality of reference voltages Vref applied to the data-sensing driver 130.

The timing controller 160 is configured to receive a control signal CONT and image data DATA1 from an external device. The timing controller 160 is configured to generate the first, second and third control signals CONT1, CONT2 and CONT3 using the control signal CONT.

According to an exemplary embodiment, referring to FIG. 2, the timing controller 160 may include a calculator 310 and a compensator 320.

The calculator 310 is configured to calculate a compensation coefficient for compensating degradations of a driving transistor and the organic light-emitting diode in the pixel circuit based on the sensing data SD received from the data-sensing driver 130.

The compensator 320 is configured to calculate compensation data of the pixel circuit based on the compensation coefficient, and to generate compensation image data DATA2 of the pixel circuit corresponding to the image data DATA1 of the pixel circuit using the compensation data. The compensator 320 is configured to provide the data-sensing driver 130 with the compensation image data DATA2 for compensating the degradations of the driving transistor and the organic light-emitting diode the in the pixel circuit. The data-sensing driver 130 is configured to convert the compensation image data DATA2 to the data voltage and to output the data voltage to the data line through the amplifier.

Referring to FIG. 3, driving periods of the organic light-emitting display device may include a power-off period POWER_OFF and a display period DISPLAY_ON. In the display period DISPLAY_ON, the organic light-emitting display device may display an image. The display period DISPLAY_ON may include a plurality of frame periods. Each of the frame periods may include a vertical blank period VB, in which the pixel circuit does not emit the light, and an emission period ACT_EM in which the pixel circuit emits the light.

Driving periods of the organic light-emitting display device may include a sensing period, in which the threshold voltage of the driving transistor and a driving current through the organic light-emitting diode are sensed from the pixel circuit to compensate the degradations of the driving transistor and the organic light-emitting diode OLED.

According to an exemplary embodiment, the sensing period may be defined in the power-off period POWER_OFF.

In an alternative exemplary embodiment, the sensing period may be defined in the vertical blank period VB of the display period DISPLAY_ON. The display period DISPLAY_ON may include a plurality of frame periods, each frame period may include a vertical blank period VB in which the organic light-emitting diode does not emit the light and an active period in which the organic light-emitting diode emit the light. When the sensing period is predetermined in the vertical blank period VB, the sensing signal corresponding to the degradations of the pixel circuit is sensed in the real time during displaying the image.

Figure 4:
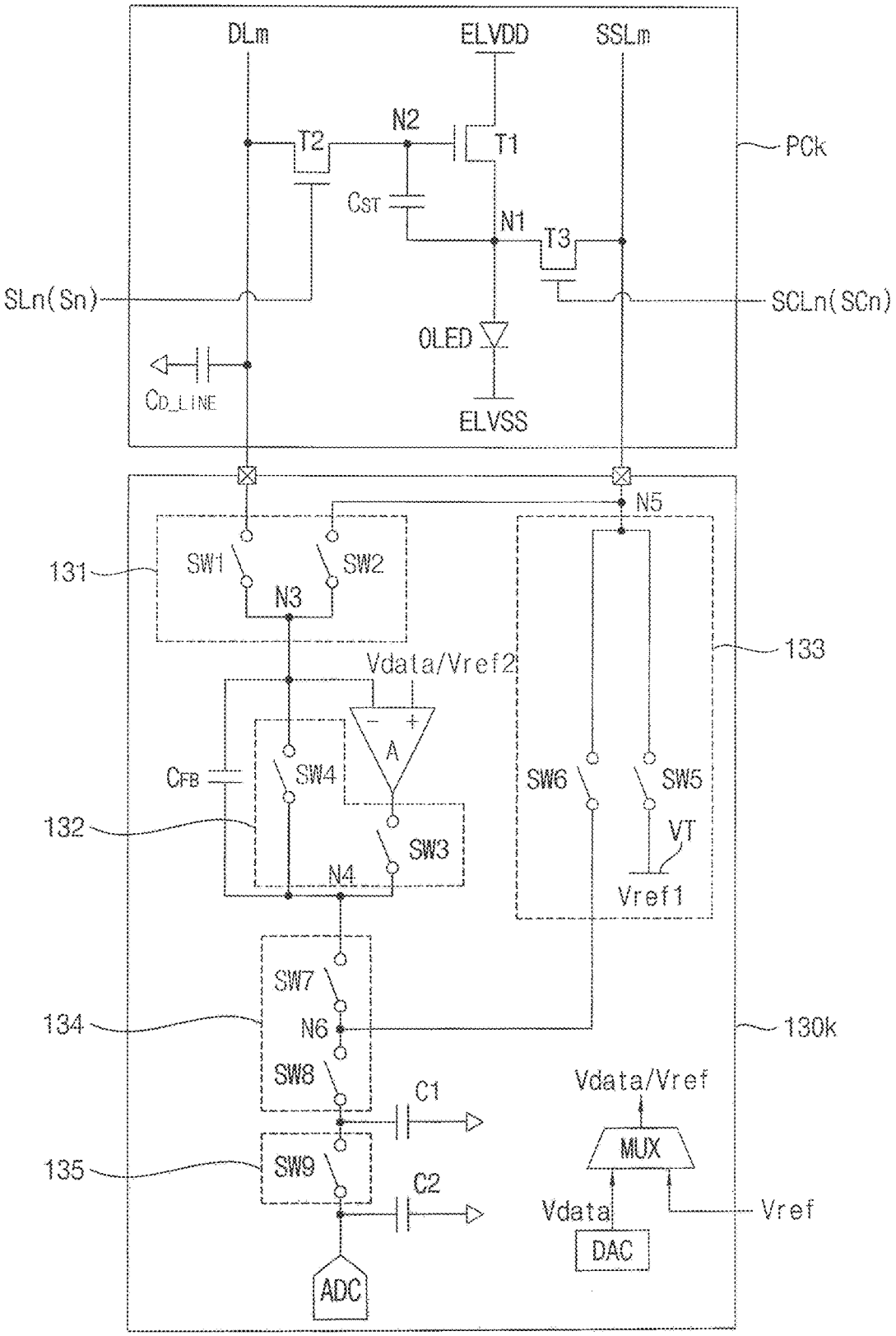
FIG. 4 is a circuit diagram illustrating an organic light-emitting display device according to an exemplary embodiment.

FIG. 4 is a circuit diagram illustrating an organic light-emitting display device according to an exemplary embodiment.

Referring to FIGS. 1 and 4, the organic light-emitting display device may include a pixel circuit and a data-sensing circuit connected to the pixel circuit.

For convenience of illustration and description, FIG. 4 shows a pixel circuit PCk of a k-th pixel and a data-sensing circuit 130*k* connected to the pixel circuit PCk of the k-th pixel. In such an embodiment, other pixel circuits and the data-sensing circuits connected thereto may have structures substantially the same as those shown in FIG. 4, and any repetitive detailed description thereof will be omitted.

In an exemplary embodiment, the pixel circuit PCk may include a driving transistor T1, a storage capacitor $C_{ST}$, a switching transistor T2, an organic light-emitting diode OLED and a sensing transistor T3.

The pixel circuit PCk may be connected to an m-th data line DLm, an m-th sensing line SSLm, an n-th scan line SLn and an n-th sensing control line SCLn (here, 'n' and 'm' are natural numbers).

The switching transistor T2 includes a control electrode connected to the n-th scan line SLn, a first electrode connected to the m-th data line DLm and a second electrode connected to a second node N2. The switching transistor T2 may be turned on in response to a turn-on voltage (hereinafter, will be referred to as "ON voltage") of an n-th scan signal Sn applied to the n-th scan line SLn.

The storage capacitor $C_{ST}$ may include a first electrode connected to the second node N2 and a second electrode connected to the first node N1.

The driving transistor T1 includes a control electrode connected to the second node N2, a first electrode to which the first power source voltage ELVDD is applied and a second electrode connected to the first node N1. The driving transistor T1 is configured to provide the organic light-emitting diode OLED with a current corresponding to a voltage stored in the storage capacitor $C_{ST}$.

The organic light-emitting diode OLED may include an anode electrode connected to the first node N1 and a cathode electrode to which a second power source voltage ELVSS is applied. The organic light-emitting diode OLED may emit the light corresponding to a current flowing between the first node N1 and the second power source voltage ELVSS.

The sensing transistor T3 includes a control electrode connected to the n-th sensing control line SCLn, a first electrode connected to the m-th sensing line SSLm and a second electrode connected to the first node N1. The sensing transistor T3 is connected between the m-th sensing line SSLm and the first node N1, and the sensing transistor T3 is turned on in response to an ON voltage of the n-th sensing control signal SCn applied to the n-th sensing control line SCLn.

In an exemplary embodiment, as shown in FIG. 4, the data-sensing circuit 130*k* may include a first selector 131, an amplifier (AMP) A, a feedback capacitor $C_{FB}$, a second selector 132, a third selector 133, a first capacitor C1, a fourth selector 134, a fifth selector 135, a second capacitor C2 and a converter ADC. The data-sensing circuit 130*k* may further include a digital-to-analog converter DAC and a multiplexer MUX.

The first selector 131 may selectively connect the m-th data line DLm and the m-th sensing line SSLm to a third node N3.

The first selector 131 may include a first switch SW1 and a second switch SW2. The first switch SW1 is connected between the m-th data line DLm and the third node N3. The second switch SW2 is connected between the m-th sensing line SSLm and the third node N3.

The amplifier A may include a first input terminal (−), a second input terminal (+) and an output terminal. The first input terminal (−) is connected to the third node N3, the second input terminal (+) is connected to the multiplexer MUX and the output terminal is connected to the second selector 132, e.g., a third switch SW3 therein. The multiplexer MUX selectively outputs the data voltage Vdata provided from the digital-to-analog converter DAC and the plurality of reference voltages Vref provided from the voltage generator 150 to the second input terminal (+) of the amplifier A.

In one exemplary embodiment, for example, the second input terminal (+) of the amplifier A is configured to receive the data voltage Vdata in the emission period ACT_EM shown in FIG. 3. In such an embodiment, the second input terminal (+) of the amplifier A is configured to receive a second reference voltage Vref2 in the sensing period. The second reference voltage Vref2 may have various predetermined levels for sensing.

The feedback capacitor $C_{FB}$ is connected between the first input terminal (−) and the output terminal of the amplifier A. In one exemplary embodiment, for example, the feedback capacitor $C_{FB}$ may be connected to the output terminal of the amplifier A through the second selector 132 or a fourth node N4.

The second selector 132 may include a third switch SW3 and a fourth switch SW4.

The third switch SW3 is connected between the output terminal of the amplifier A and the fourth node N4. The fourth switch SW4 is connected between the fourth node N4 and the third node N3.

The third selector 133 selectively connects the m-th sensing line SSLm to a voltage terminal VT to which the first reference voltage Vref1 is applied or a sixth node N6.

The third selector 133 may include a fifth switch SW5 and a sixth switch SW6. The fifth switch SW5 is connected between the voltage terminal VT and a fifth node N5 connected to the m-th sensing line SSLm. The sixth switch SW6 is connected between the fifth node N5 and the sixth node N6 in the fourth selector 134.

The first capacitor C1 stores a sensing signal. The first capacitor C1 is connected between the fourth selector 134 and a ground.

The fourth selector 134 selectively connects the second selector 132 connected to the output terminal of the amplifier A and the third selector 133 to the first capacitor C1.

The fourth selector 134 may include a seventh switch SW7 and an eighth switch SW8.

The seventh switch SW7 is connected between the second selector 132 and the third selector 133. The seventh switch SW7 is connected between the fourth node N4 and the sixth node N6. The eighth switch SW8 is connected between the seventh switch SW7 and the first capacitor C1.

The fifth selector 135 selectively connects the first capacitor C1 to the converter ADC. The fifth selector 135 may include a ninth switch SW9.

The ninth switch SW9 is connected between the first capacitor C1 and the converter ADC.

The converter ADC is connected to the fifth selector 135 and a second capacitor C2. The second capacitor C2 is connected between the converter ADC and the ground. The converter ADC is configured to convert the sensing signal stored in the second capacitor C2 to sensing data and output the sensing data.

Figure 5:
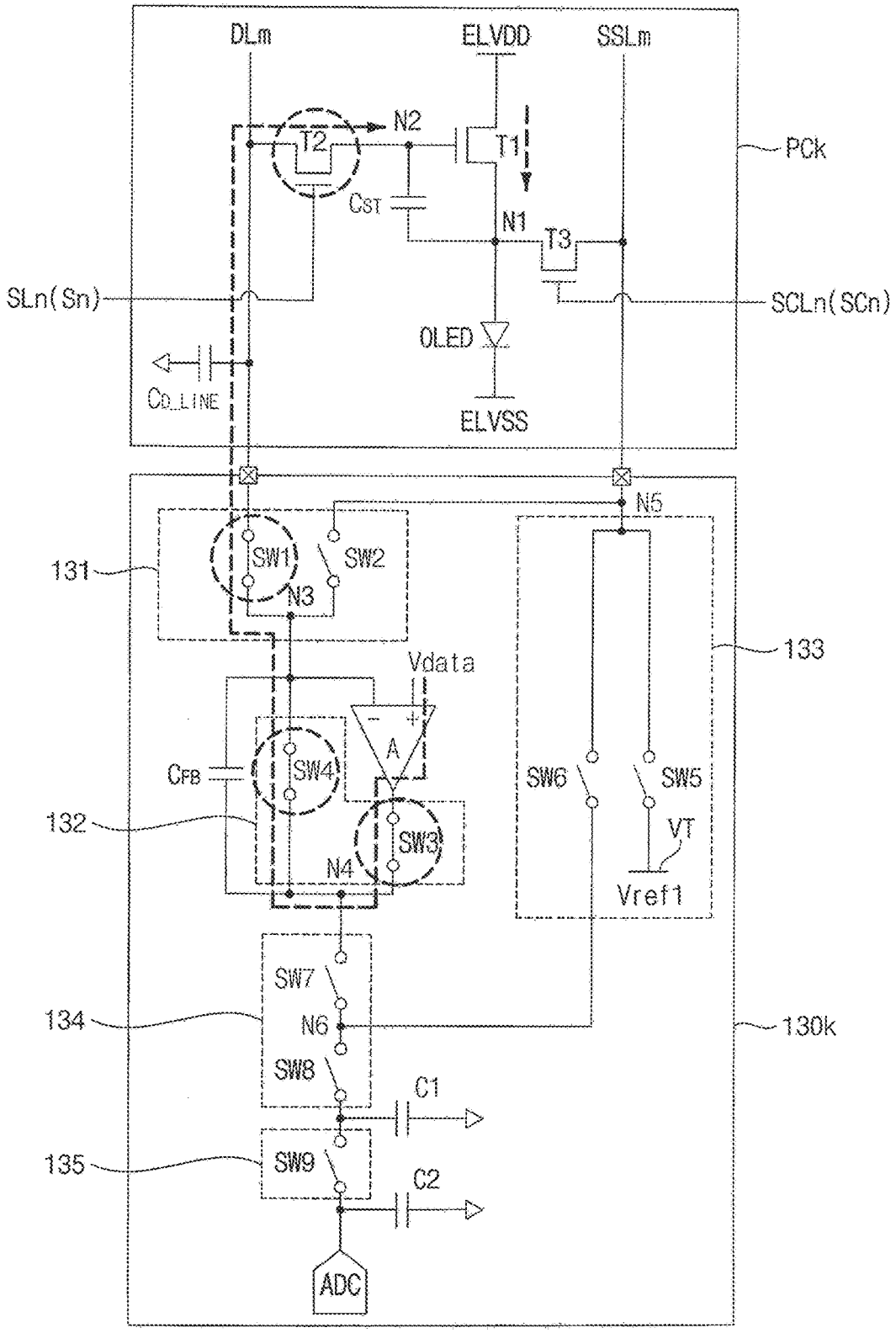
FIG. 5 is a conceptual diagram illustrating a method of driving an organic light-emitting display device in an emission period according to an exemplary embodiment.

FIG. 5 is a conceptual diagram illustrating a method of driving an organic light-emitting display device in an emission period according to an exemplary embodiment.

Referring to FIGS. 3 and 5, driving operations of the pixel circuit PCk and the data-sensing circuit 130*k* in the emission period ACT_EM of the frame period will be described in detail.

In the emission period ACT_EM, the data-sensing circuit 130*k* receives the data voltage Vdata through the second input terminal (+) of the amplifier A.

In such an embodiment, the data-sensing circuit 130*k* turns on the first switch SW1 of the first selector 131, and the third and fourth switches SW3 and SW4 of the second selector 132 in the emission period ACT_EM. The data-sensing circuit 130*k* turns off remaining switches SW2, SW5, SW6, SW7, SW8 and SW9 in the emission period ACT_EM. Thus, the data-sensing circuit 130*k* outputs the data voltage Vdata to the m-th data line DLm.

In the pixel circuit PCk, the switching transistor T2 is turned on in response to an ON voltage of the n-th scan signal Sn. When the switching transistor T2 is turned on, the storage capacitor $C_{ST}$ stores a voltage corresponding to the data voltage Vdata applied to the m-th data line DLm.

The driving transistor T1 provides the organic light-emitting diode OLED with a driving current corresponding to the voltage stored in the storage capacitor $C_{ST}$. The organic light-emitting diode OLED may emit the light corresponding to the driving current. Thus, the organic light-emitting diode OLED may display an image.

According to an exemplary embodiment, the sensing period may include an initializing period and a signal sensing period. In the initializing period, a gate/source voltage (VGS) of the driving transistor T1 is formed in the pixel circuit and the sensing line is initialized. In the signal sensing period, the sensing signal, which is a threshold voltage of the driving transistor T1 or the driving current through the organic light-emitting diode OLED formed by the gate/source voltage (VGS), is sensed from the pixel circuit.

Figure 6:
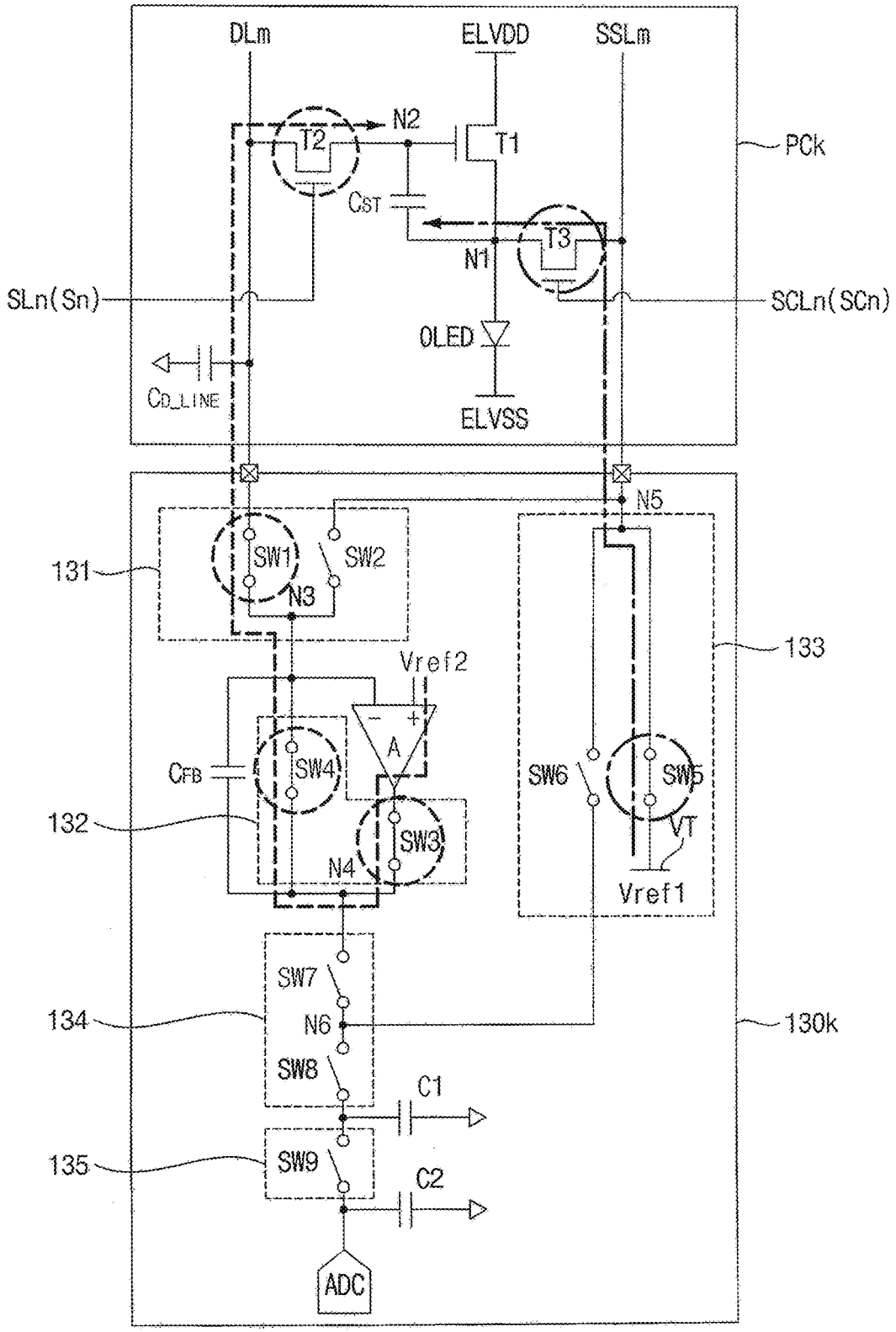
FIG. 6 is a conceptual diagram illustrating a method of initializing an organic light-emitting display device in a sensing period according to an exemplary embodiment.

FIG. 6 is a conceptual diagram illustrating a method of initializing an organic light-emitting display device in a sensing period according to an exemplary embodiment.

Referring to FIG. 6, the data-sensing circuit 130*k* forms the gate/source voltage (VGS) of the driving transistor T1 in the pixel circuit PCk and initializes the m-th sensing line SSLm in the sensing period.

The data-sensing circuit 130*k* receives the first reference voltage Vref1 from the voltage terminal VT of the third selector 133, and the second reference voltage Vref2 from the second input terminal (+) of the amplifier A.

In such an embodiment, the data-sensing circuit 130*k* turns on the first switch SW1 of the first selector 131, the third and fourth switches SW3 and SW4 of the second selector 132, and the fifth switch SW5 of the third selector 133 in the sensing period. The data-sensing circuit 130*k* turns off remaining switches SW2, SW6, SW7, SW8 and SW9 in the sensing period.

Thus, the second reference voltage Vref2 applied to the second input terminal (+) of the amplifier A may be applied to the m-th data line DLm, and the first reference voltage Vref1 applied to the voltage terminal VT may be applied to the m-th sensing line SSLm.

The switching transistor T2 of the pixel circuit PCk is turned on in response to the ON voltage of the n-th scan signal Sn, and the second node N2 receives a voltage corresponding to the second reference voltage Vref2. The sensing transistor T3 is turned on in response to the ON voltage of the n-th sensing control signal SCn, and the first node N1 receives a voltage corresponding to the first reference voltage Vref1. The storage capacitor $C_{ST}$ may store a voltage corresponding to a potential difference (Vref1−Vref2) between the first reference voltage Vref1 and the second reference voltage Vref2.

Thus, a gate/source voltage (VGS=Vref1−Vref2) of the driving transistor T1 may be formed, such that the m-th sensing line SSLm may be initialized.

Hereinafter, an exemplary embodiment, where the sensing period is defined in the power-off period will be described in detail.

Figure 7A:
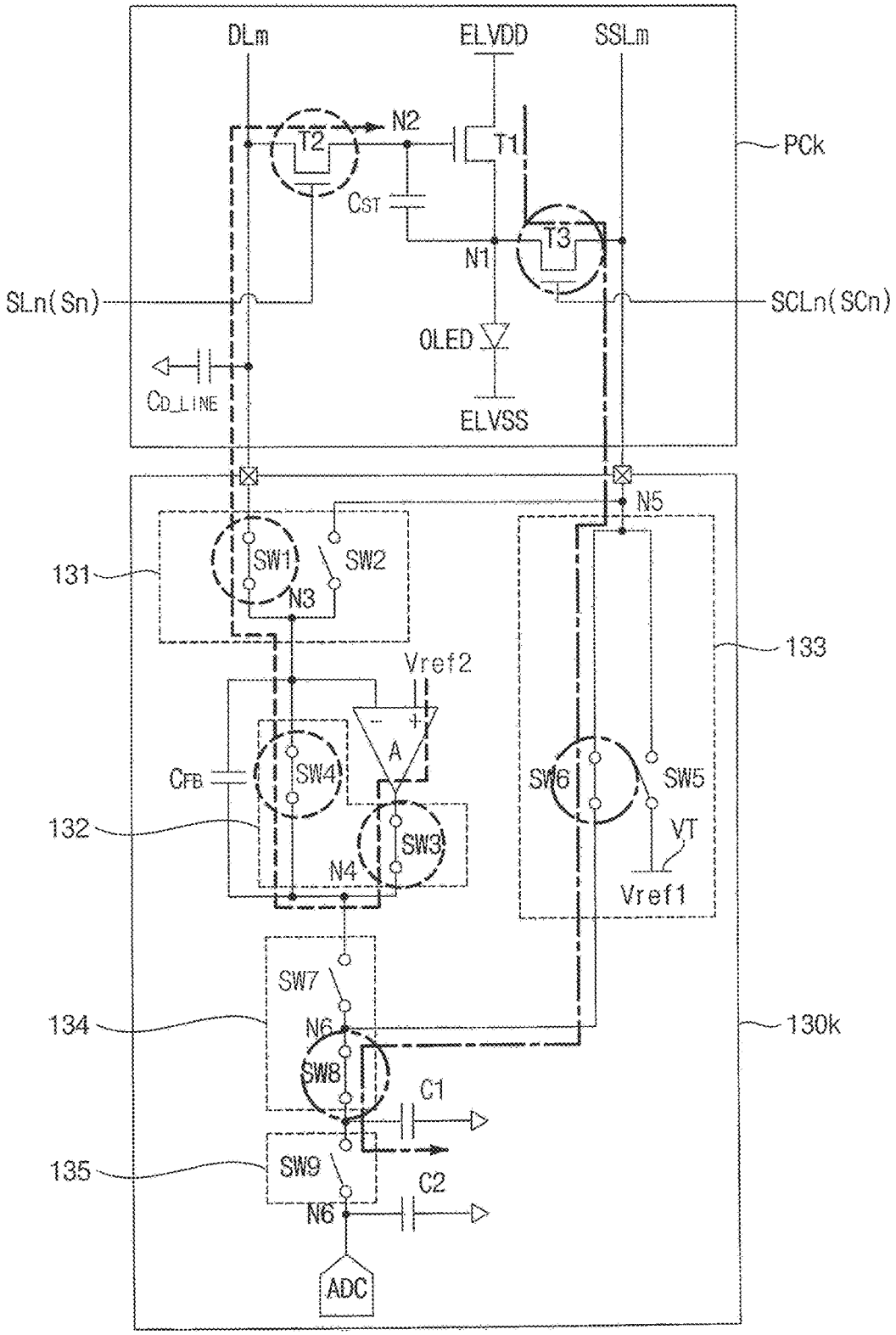
FIGS. 7A and 7B are conceptual diagrams illustrating a voltage-sensing method in a power-off period according to an exemplary embodiment.
Figure 7B:
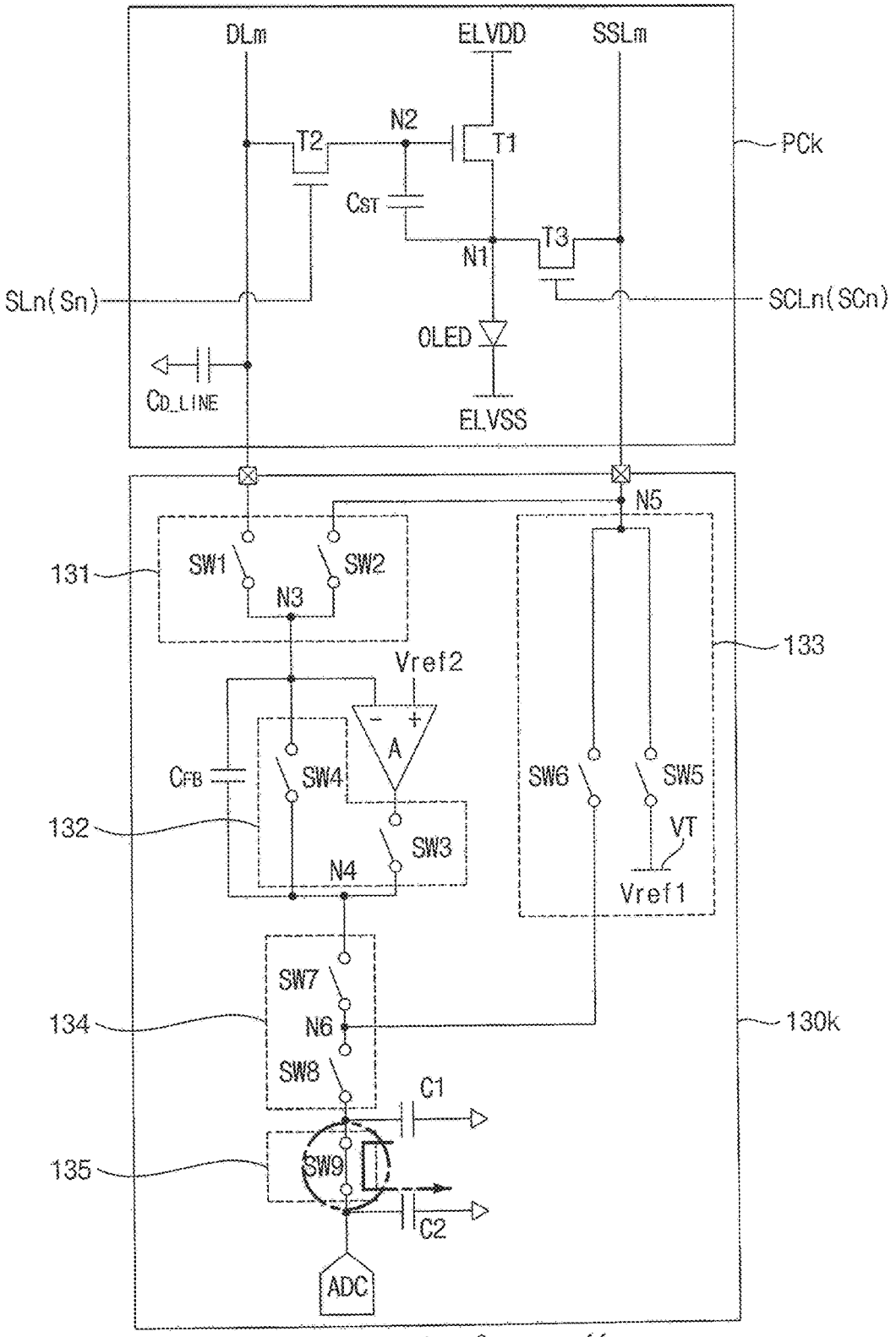

FIGS. 7A and 7B are conceptual diagrams illustrating a voltage-sensing method in a power-off period according to an exemplary embodiment.

Referring to FIG. 7A, a voltage-sensing operation for sensing a sensing voltage by the data-sensing circuit 130*k* and the pixel circuit PCk will be described in detail. After forming the gate/source voltage (VGS) and initializing the sensing line as the described above referring to FIG. 6, the voltage-sensing operation may be performed.

The data-sensing circuit 130*k* receives the second reference voltage Vref2 through the second input terminal (+) of the amplifier A.

The data-sensing circuit 130*k* turns on the first switch SW1 of the first selector 131, the third and fourth switches SW3 and SW4 of the second selector 132, the sixth switch SW6 of the third selector 133 and the eighth switch SW8 of the fourth selector 134. The data-sensing circuit 130*k* turns off remaining switches SW2, SW5, SW7 and SW9.

Thus, the second reference voltage Vref2 is applied to the m-th data line DLm.

The switching transistor T2 in the pixel circuit PCk is turned on in response to the ON voltage of the n-th scan signal Sn, and the second reference voltage Vref2 applied to the m-th data line DLm is applied to the control electrode of the driving transistor T1. The driving transistor T1 is turned on in response to the second reference voltage Vref2. The first node N1 connected to the second electrode of the driving transistor T1 receives a sensing voltage corresponding to the threshold voltage (VTH) of the driving transistor T1.

The sensing transistor T3 in the pixel circuit PCk is turned on in response to the ON voltage of the n-th sensing control signal SCn. When the sensing transistor T3 is turned on, the sensing voltage corresponding to the threshold voltage (VTH) applied to the first node N1 is applied to the m-th sensing line SSLm.

The sensing voltage is stored in the first capacitor C1 through the m-th sensing line SSLm and the fourth selector 134.

Referring to FIG. 7B, when the sensing voltage is stored in the first capacitor C1, the data-sensing circuit 130*k* turns on the ninth switch SW9 of the fifth selector 135 and turns off remaining switches SW1, SW2, SW3, SW4, SW5, SW6, SW7 and SW8.

Thus, the sensing voltage stored in the first capacitor C1 is stored in the second capacitor C2 and is applied to the converter ADC. The sensing voltage applied to the converter ADC may correspond to a difference between the second reference voltage Vref2 and the threshold voltage (VTH).

The converter ADC converts the sensing voltage to sensing data and outputs the sensing data.

Figure 8:
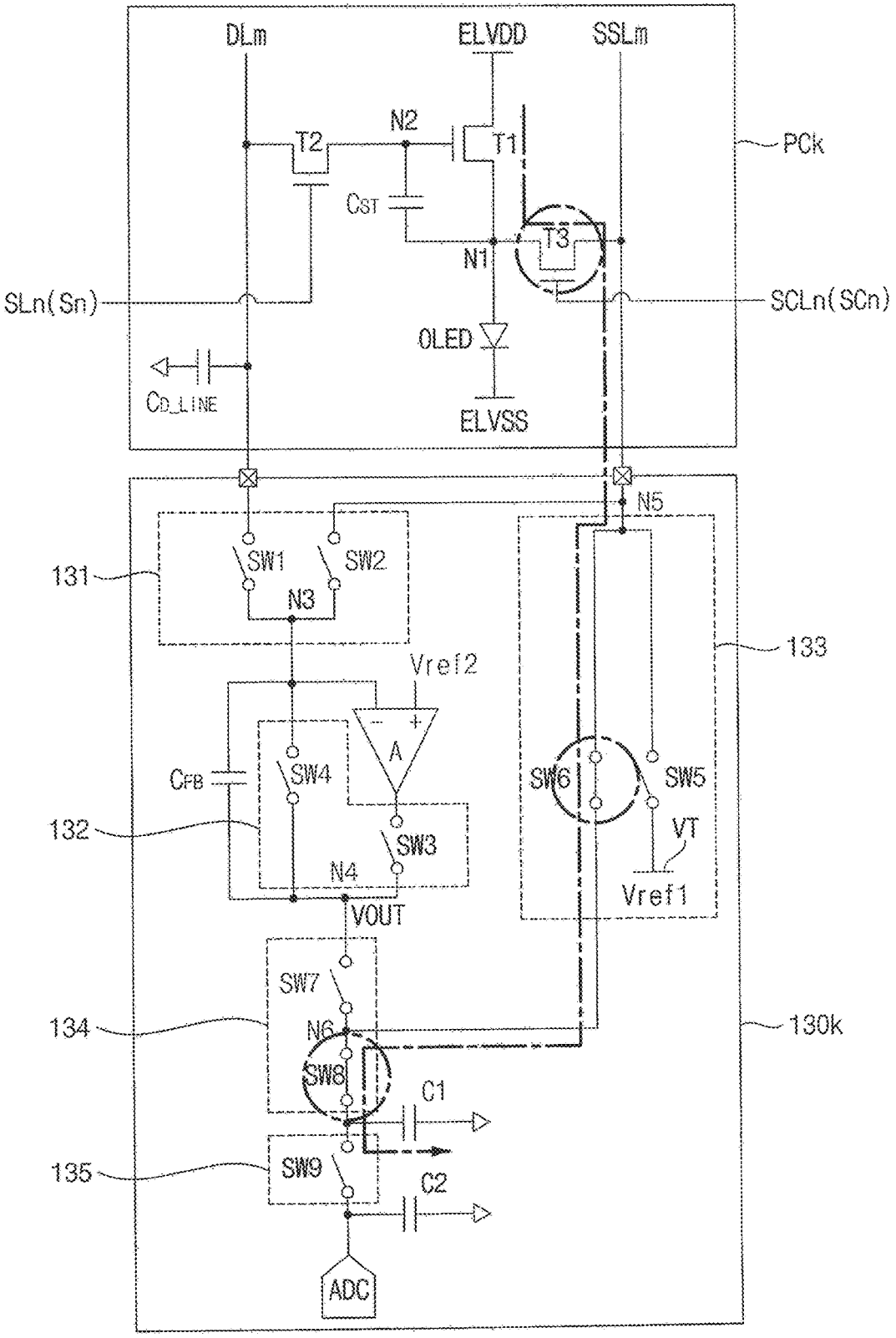
FIG. 8 is a conceptual diagram illustrating a current-sensing method in a power-off period according to an exemplary embodiment.

FIG. 8 is a conceptual diagram illustrating a current-sensing method in a power-off period according to an exemplary embodiment.

Referring to FIG. 8, a current-sensing operation for sensing a sensing current by the data-sensing circuit 130*k* and the pixel circuit PCk will be described in detail. After forming the gate/source voltage (VGS) and initializing the sensing line as described above referring to FIG. 6, the current-sensing operation may be performed by the data-sensing circuit 130*k* and the pixel circuit PCk.

After forming the gate/source voltage (VGS) and initializing the sensing line, the data-sensing circuit 130*k* turns on the sixth switch SW6 of the third selector 133 and the eighth switch SW8 of the fourth selector 134, and the data-sensing circuit 130*k* turns off remaining switches SW1, SW2, SW3, SW4, SW5, SW7 and SW9.

In the pixel circuit PCk, the driving transistor T1 is turned on based on a voltage (Vref2) stored in the storage capacitor $C_{ST}$ such that a driving current flows into the first node N1 connected to the anode electrode of the organic light-emitting diode OLED.

The sensing transistor T3 is turned on in response to the ON voltage of the n-th sensing control signal SCn. When the sensing transistor T3 is turned on, the driving current applied to the first node N1 is stored in the first capacitor C1 through the m-th sensing line SSLm and the fourth selector 134. The first capacitor C1 stores a sensing voltage corresponding to the driving current.

Then, referring to FIG. 7B, the data-sensing circuit 130*k* turns on the ninth switch SW9 of the fifth selector 135 and turns off remaining switches SW1, SW2, SW3, SW4, SW5, SW6, SW7 and SW8.

Thus, the sensing voltage stored in the first capacitor C1 is stored in the second capacitor C2 and is applied to the converter ADC.

The converter ADC converts the sensing voltage to sensing data and outputs the sensing data.

In an exemplary embodiment, the sensing period may be defined in the display period. The display period includes a vertical blank period and the vertical blank period includes the sensing period. The sensing period includes the initializing period as the described above referring to FIG. 6 and a signal sensing period in which the sensing signal is sensed. The sensing signal may correspond to the threshold voltage and the driving current of the organic light-emitting diode OLED. The signal sensing period may correspond to a voltage-sensing period in which the threshold voltage is sensed and a current-sensing period in which the driving current is sensed.

Figure 9A:
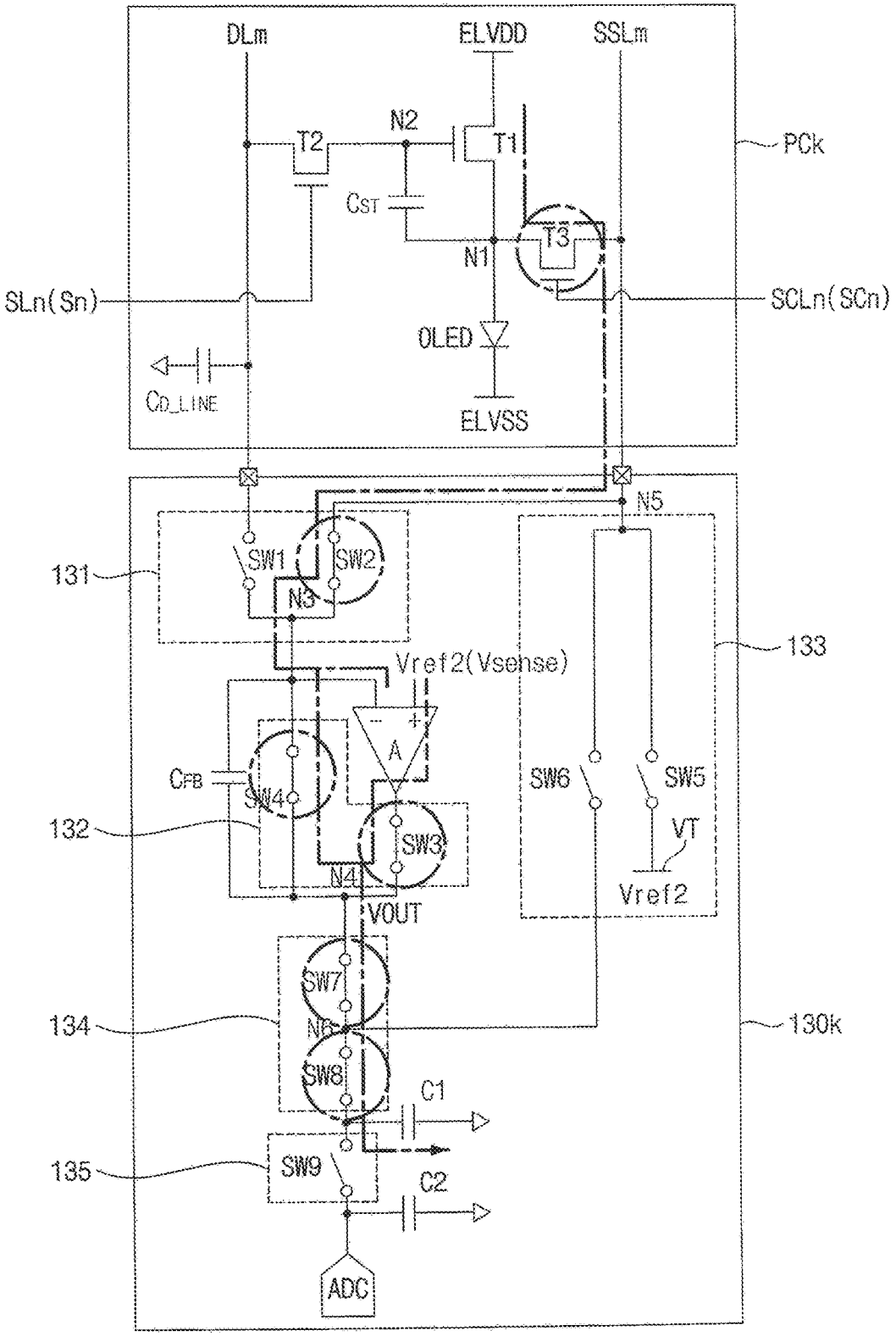
FIGS. 9A and 9B are conceptual diagrams illustrating a fast current-sensing method in a display period according to an exemplary embodiment.
Figure 9B:
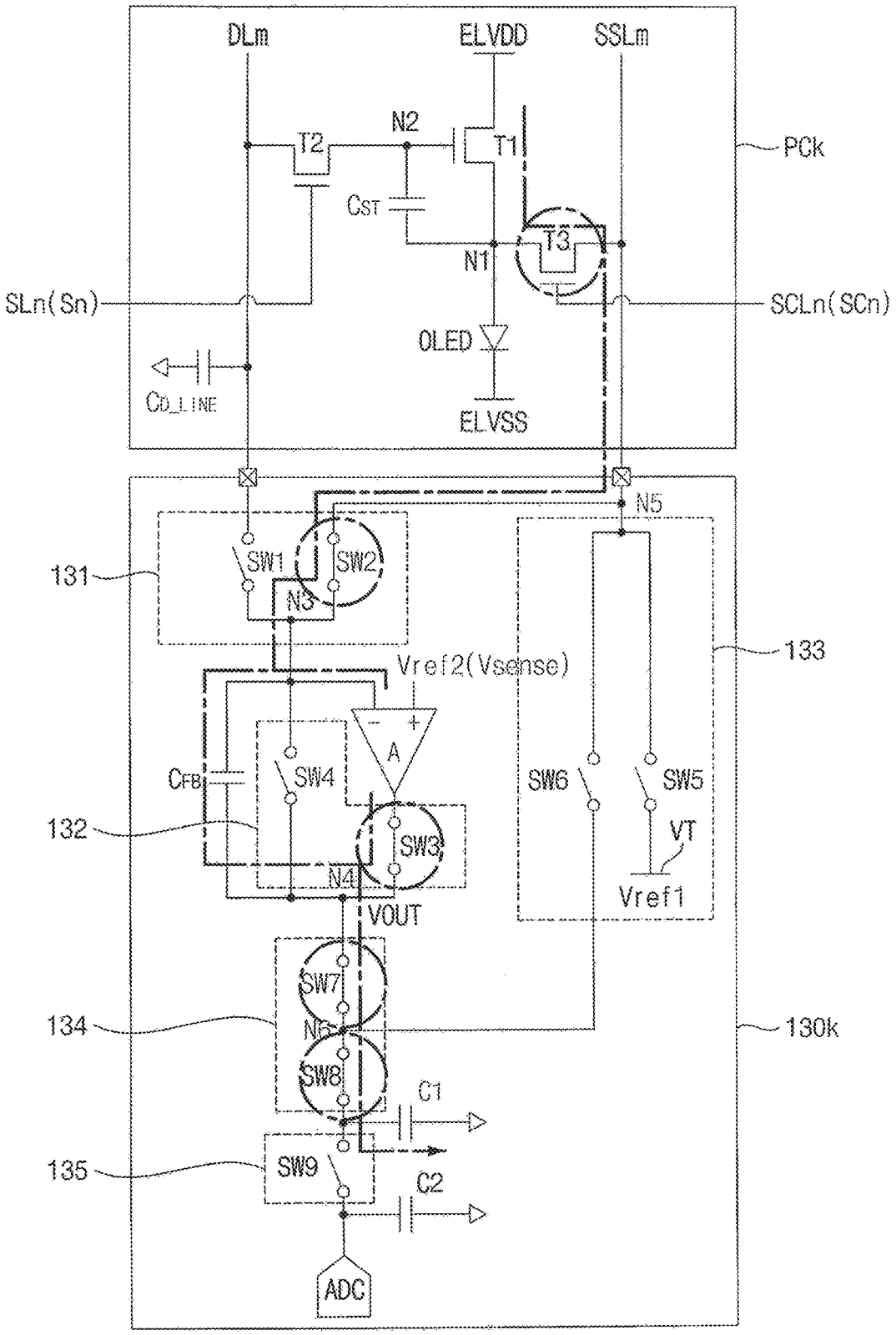

FIGS. 9A and 9B are conceptual diagrams illustrating a fast current-sensing method in a display period according to an exemplary embodiment.

According to an exemplary embodiment, a fast current-sensing operation in the display period may include resetting the amplifier A and sensing the driving current. After forming the gate/source voltage (VGS) and initializing the sensing line as described above referring to FIG. 6, the fast current-sensing operation may be performed.

Referring to FIG. 9A, the data-sensing circuit 130*k* resets the amplifier A and the feedback capacitor $C_{FB}$.

In one exemplary embodiment, for example, the data-sensing circuit 130*k* receives a second reference voltage Vref2 having a voltage level (Vsense) through the second input terminal (+) of the amplifier A.

In such an embodiment, the data-sensing circuit 130*k* turns on the second switch SW2 of the first selector 131, the third and fourth switches SW3 and SW4 of the second selector 132 and the seventh and eighth switches SW7 and SW8 of the fourth selector 134, and the data-sensing circuit 130*k* turns off remaining switches SW1, SW5, SW6 and SW9.

In the pixel circuit PCk, the switching transistor T2 is turned off in response to a turn-off voltage (hereinafter, will be referred to as "OFF voltage") of the n-th scan signal Sn, and the sensing transistor T3 is turned on in response to the ON voltage of the n-th sensing control signal SCn. The driving transistor T1 is turned on based on a voltage stored in the storage capacitor $C_{ST}$ by the initializing period described referring to FIG. 6.

Thus, a current may flow between the driving transistor T1 receiving a first power source voltage ELVDD, the m-th sensing line SSLm, the amplifier A, the first capacitor C1 and the ground, as shown in FIG. 9A.

Thus, the amplifier A may be reset. In such an embodiment, both terminals of the feedback capacitor $C_{FB}$ which is connected between the input terminal and the output terminal of the amplifier A receive a same voltage as each other and thus, the feedback capacitor $C_{FB}$ may be reset.

Then, referring to FIG. 9B, the data-sensing circuit 130*k* may sense the driving current flowing into the organic light-emitting diode OLED in the pixel circuit PCk.

In one exemplary embodiment, for example, the data-sensing circuit 130*k* receives a second reference voltage Vref2 having a voltage level (Vsense) through the second input terminal (+) of the amplifier A.

In such an embodiment, the data-sensing circuit 130*k* turns on the second switch SW2 of the first selector 131, the third switch SW3 of the second selector 132 and the seventh and eighth switches SW7 and SW8 of the fourth selector 134, and the data-sensing circuit 130*k* turns off remaining switches SW1, SW4, SW5, SW6 and SW9.

The switching transistor T2 in the pixel circuit PCk is turned off in response to the OFF voltage of the n-th scan signal Sn, and the sensing transistor T3 is turned on in response to the ON voltage of the n-th sensing control signal SCn. When the sensing transistor T3 is turned on, a sensing current (ITFT) corresponding to the driving current which flows into the organic light-emitting diode OLED is applied to the amplifier A and the feedback capacitor $C_{FB}$.

The sensing current (ITFT) may be defined by the following Equation 1.

$$ITFT = C_{FB} \times (Vsense - VOUT)/TINT \quad \text{[Equation 1]}$$

In Equation 1, ITFT denotes the sensing current, Vsense denotes an input voltage of the amplifier A, VOUT denotes an output voltage of the amplifier A, and TINT denotes an integration time.

The sensing current (ITFT) is integrated by the amplifier A and feedback capacitor $C_{FB}$, and an output voltage (VOUT) corresponding to the sensing current (ITFT) is outputted through the output terminal of the amplifier A.

The output voltage (VOUT) is stored in the first capacitor C1.

Then, referring to FIG. 7B, the data-sensing circuit 130*k* turns on the ninth switch SW9 of the fifth selector 135 and turns off remaining switches SW1, SW2, SW3, SW4, SW5, SW6, SW7 and SW8.

Thus, the output voltage (VOUT) stored in the first capacitor C1 is stored in the second capacitor C2 and is applied to the converter ADC.

The converter ADC converts the output voltage (VOUT) to sensing data and outputs the sensing data.

FIGS. 10A to 10D are conceptual diagrams illustrating a fast voltage-sensing method in a display period according to an exemplary embodiment.

According to an exemplary embodiment, a fast voltage-sensing operation in the display period may include forming the threshold voltage, forming a swing voltage, initializing the sensing line by using the amplifier and sensing the threshold voltage. After forming the gate/source voltage (VGS) and initializing the sensing line as described above referring to FIG. 6, the fast voltage-sensing operation may be performed.

Figure 10A:
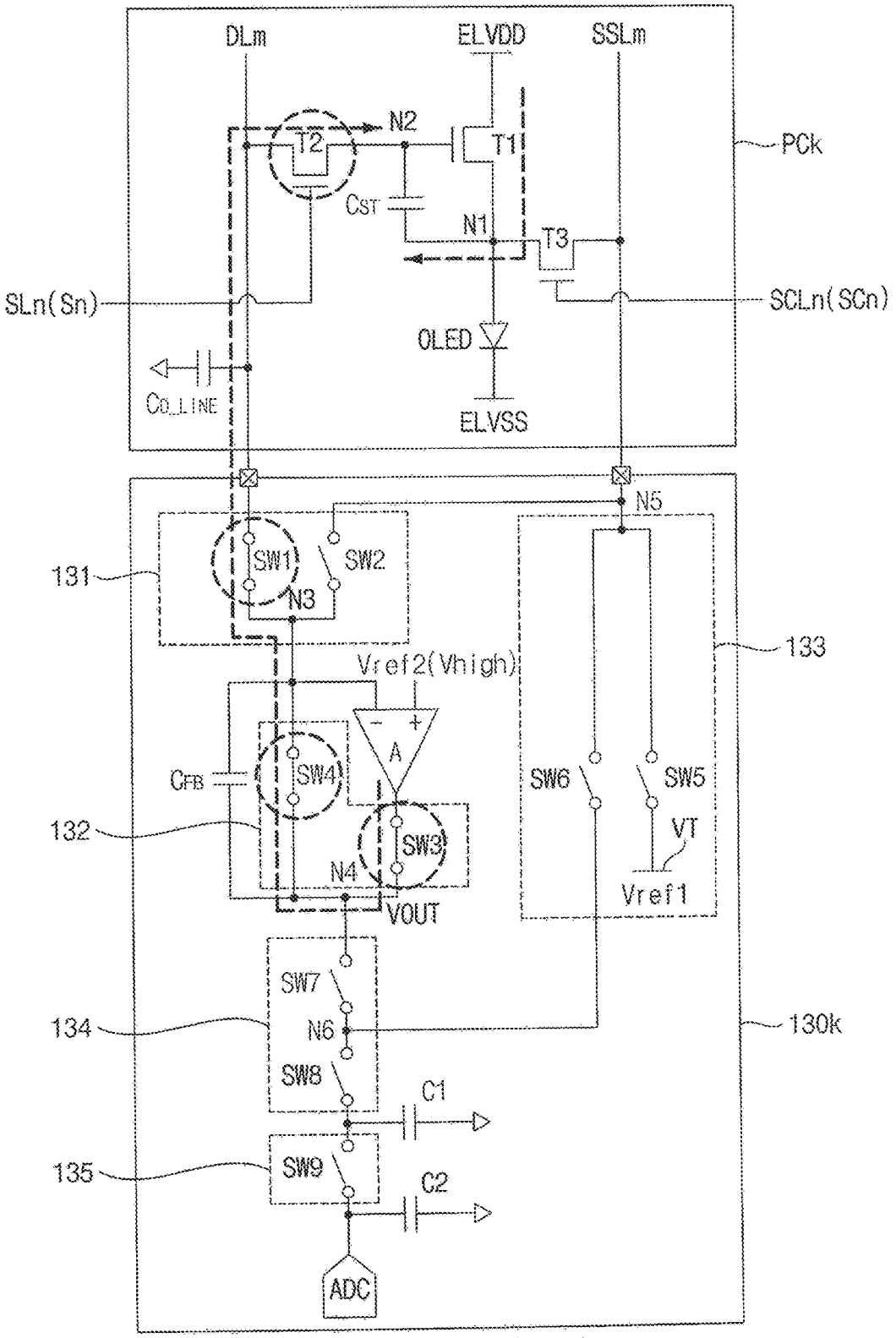
FIGS. 10A to 10D are conceptual diagrams illustrating a fast voltage-sensing method in a display period according to an exemplary embodiment.

Referring to FIG. 10A, in a first period, the data-sensing circuit 130*k* forms the threshold voltage (VTH) of the driving transistor T1 in the pixel circuit PCk.

In one exemplary embodiment, for example, the data-sensing circuit 130*k* receives a second reference voltage Vref2 having a high voltage level (Vhigh) through the second input terminal (+) of the amplifier A to form the threshold voltage (VTH).

The data-sensing circuit 130*k* turns on the first switch SW1 of the first selector 131 and the third and fourth switches SW3 and SW4 of the second selector 132, and the data-sensing circuit 130*k* turns off remaining switches SW2, SW5, SW6, SW7, SW8 and SW9.

Thus, the high voltage (Vhigh) is applied to the m-th data line DLm through the amplifier A.

In the pixel circuit PCk, the switching transistor T2 is turned on in response to the ON voltage of the n-th scan signal Sn, and the sensing transistor T3 is turned off in response to the OFF voltage of the n-th sensing control signal SCn.

When the switching transistor T2 is turned on, a voltage corresponding to the high voltage (Vhigh) is applied to the control electrode of the driving transistor T1. The driving transistor T1 is turned on in response to the high voltage (Vhigh). The first node N1 which is connected to the second electrode of the driving transistor T1 and the anode electrode of the organic light-emitting diode OLED receive a voltage corresponding to a potential difference (Vhigh-VTH) between the high voltage (Vhigh) and the threshold voltage (VTH). The gate/source voltage (VGS) of the driving transistor T1 may correspond to the threshold voltage (VTH).

Figure 10B:
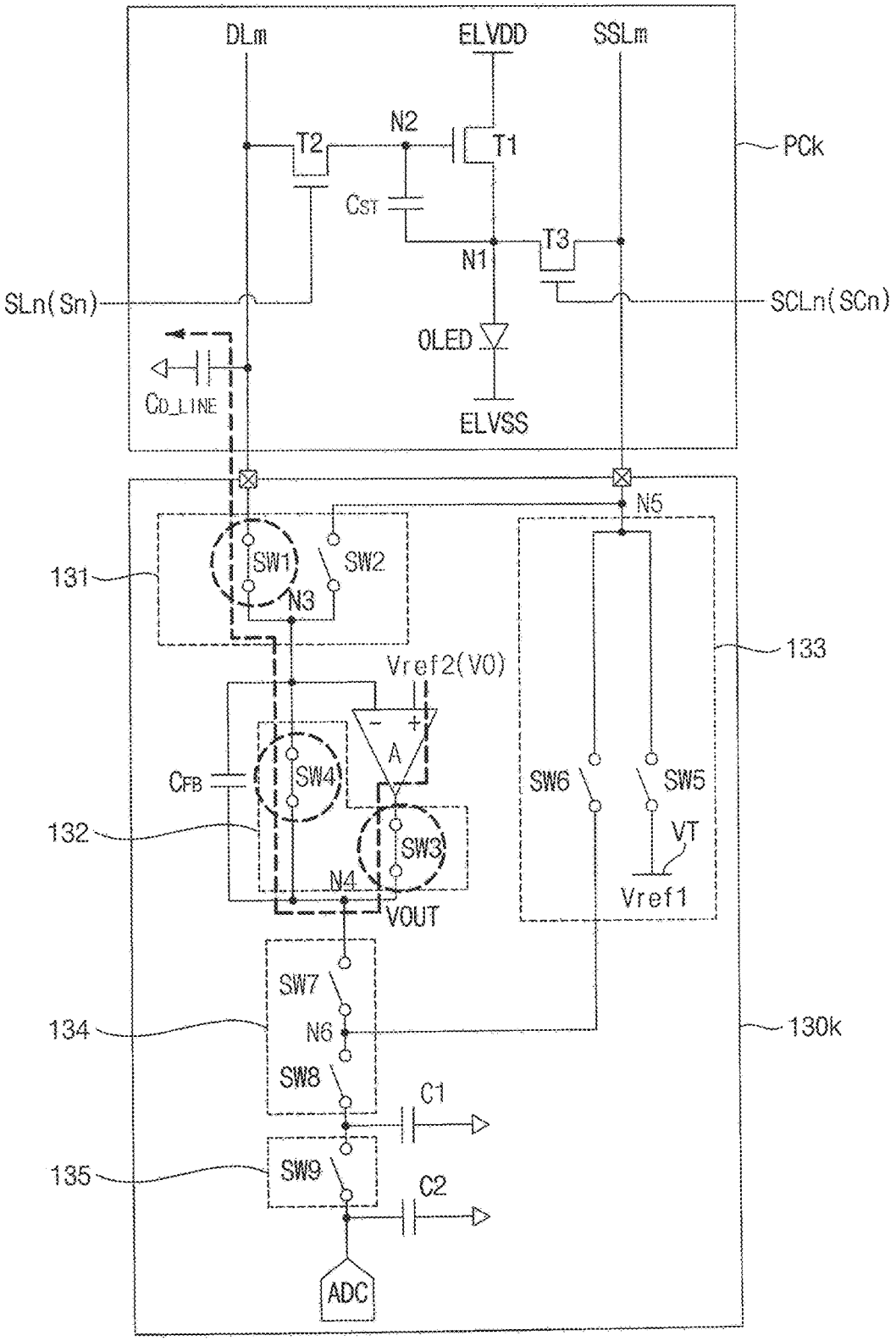

Referring to FIG. 10B, in a second period, the data-sensing circuit 130*k* applies the swing voltage (V0) to a line-capacitor CD_Line of the m-th data line DLm to adjust a dynamic range of the converter ADC.

The data-sensing circuit 130*k* receives the swing voltage (V0) as the second reference voltage Vref2 to apply the swing voltage (V0) to the m-th data line DLm through the second input terminal (+) of the amplifier A. The swing voltage (V0) may have a low level lower than the high voltage (Vhigh) described above referring to FIG. 10A.

The data-sensing circuit 130*k* turns on the first switch SW1 of the first selector 131, and the third and fourth switches SW3 and SW4 of the second selector 132, and the data-sensing circuit 130*k* turns off remaining switches SW2, SW5, SW6, SW7, SW8 and SW9.

In the pixel circuit PCk, the switching transistor T2 is turned off in response to the OFF voltage of the n-th scan signal Sn and the sensing transistor T3 is turned off in response to the OFF voltage of the n-th sensing control signal SCn. The gate/source voltage (VGS) of the driving transistor T1 may correspond to the threshold voltage (VTH).

Thus, the swing voltage (V0) is stored in the line-capacitor CD_Line of the m-th data line DLm.

In an alternative exemplary embodiment, the forming the swing voltage (V0) may be omitted.

Figure 10C:
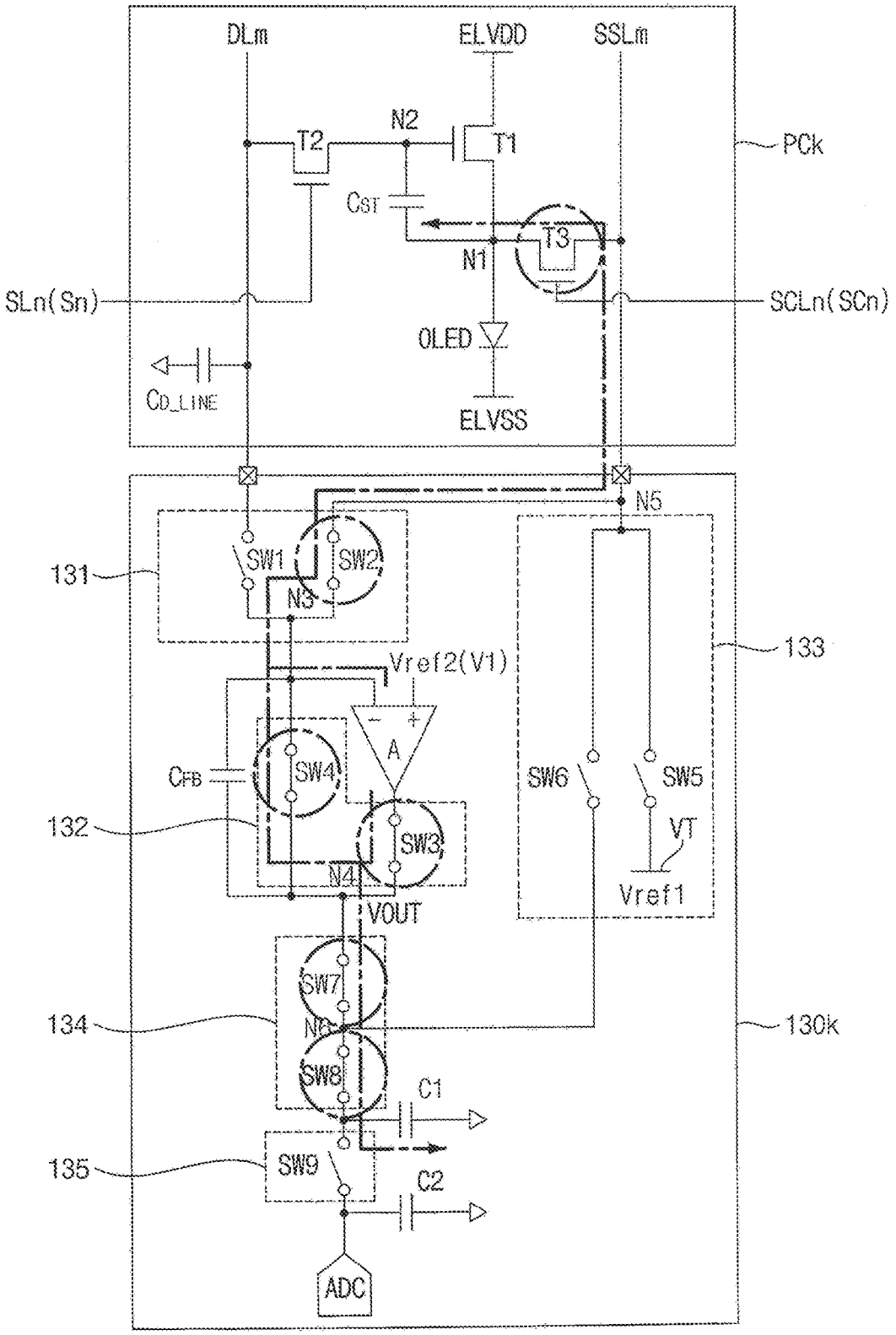

Referring to FIG. 10C, in a third period, the data-sensing circuit 130*k* initializes the m-th sensing line SSLm by using the amplifier A.

In one exemplary embodiment, for example, the data-sensing circuit 130*k* receives the second reference voltage Vref2 having an initial voltage level (V1) through the second input terminal (+) of the amplifier A to initial the m-th sensing line SSLm.

In such an embodiment, the data-sensing circuit 130*k* turns on the second switch SW2 of the first selector 131, the third and fourth switches SW3 and SW4 of the second selector 132, the seventh and eighth switches SW7 and SW8 of the fourth selector 134, and the data-sensing circuit 130*k* turns off remaining switches SW1, SW5, SW6 and SW9.

In the pixel circuit PCk, the switching transistor T2 is turned off in response to the OFF voltage of the n-th scan signal Sn and the sensing transistor T3 is turned on in response to the ON voltage of the n-th sensing control signal SCn.

Thus, the second node N2 connected to the control electrode of the driving transistor T1 receives a voltage corresponding to the potential addition (V1+VTH) of the threshold voltage (VTH) and an initial voltage (V1). The first node N1 connected to the second electrode of the driving transistor T1 receives the initial voltage (V1). Thus, the gate/source voltage (VGS) of the driving transistor T1 may correspond to the threshold voltage (VTH). The storage capacitor $C_{ST}$ may store the threshold voltage (VTH).

Both terminals of the feedback capacitor $C_{FB}$ connected between the output terminal and the first input terminal (−) of the amplifier A receive a same voltage as each other, such as the initial voltage (V1), and thus the feedback capacitor $C_{FB}$ may be initialized.

In such an embodiment, the m-th sensing line SSLm connected to the amplifier A may be initialized by the initial voltage (V1).

Figure 10D:
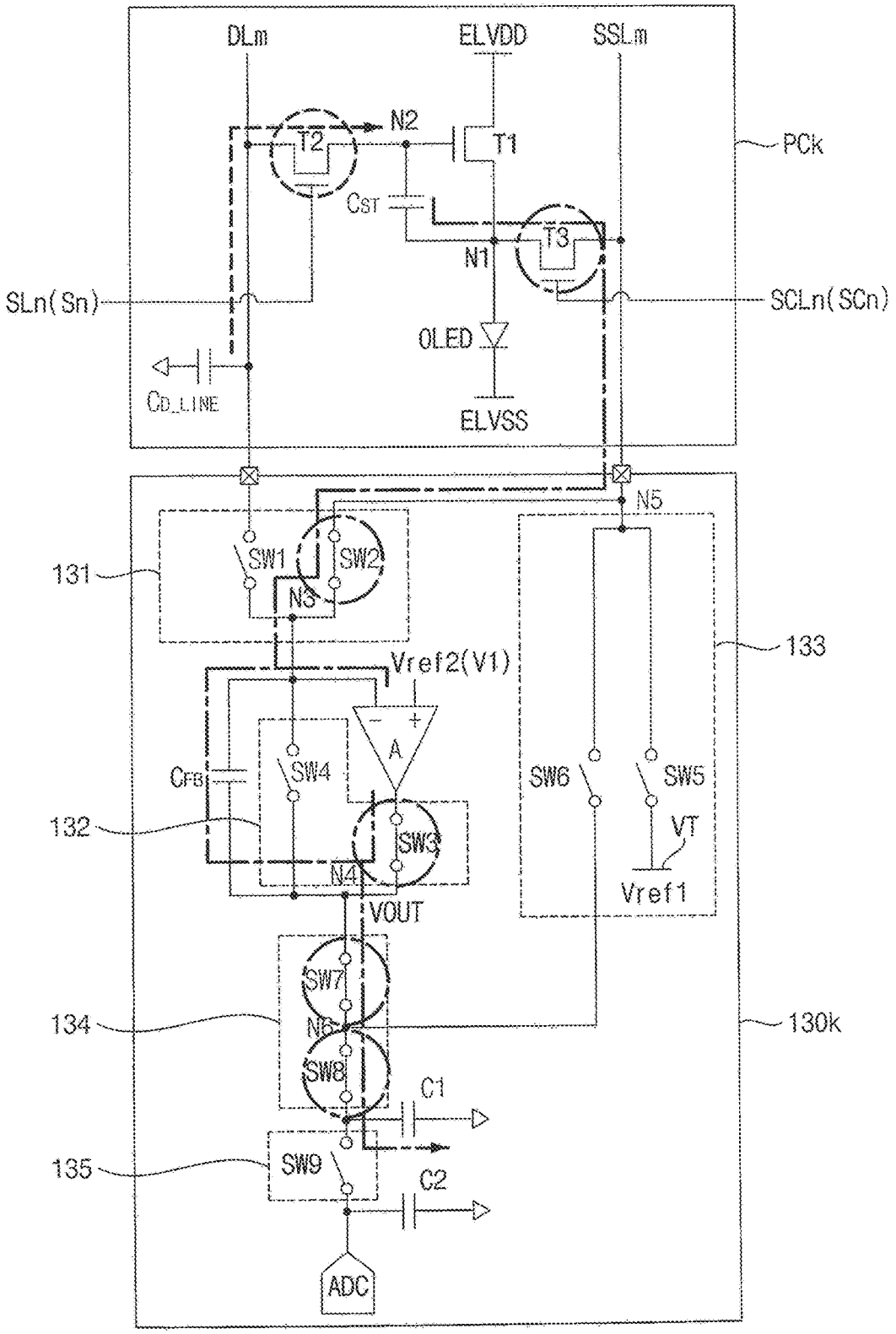

Referring to FIG. 10D, in a fourth period, the data-sensing circuit 130*k* senses the threshold voltage (VTH).

In one exemplary embodiment, for example, the data-sensing circuit 130*k* turns on the second switch SW2 of the first selector 131, the third switch SW3 of the second selector 132, the seventh and eighth switches SW7 and SW8 of the fourth selector 134, and the data-sensing circuit 130*k* turns off remaining switches SW1, SW4, SW5, SW6 and SW9.

In the pixel circuit PCk, the sensing transistor T3 is turned on in response to the ON voltage of the n-th sensing control signal SCn. When the sensing transistor T3 is turned on, the storage capacitor $C_{ST}$ is connected to the feedback capacitor $C_{FB}$ through the m-th sensing line SSLm. The threshold voltage (VTH) stored in the storage capacitor $C_{ST}$ is applied to the feedback capacitor $C_{FB}$.

Then, the switching transistor T2 is turned on in response to the ON voltage of the n-th scan signal Sn. When the switching transistor T2 is turned on, the storage capacitor $C_{ST}$ and the feedback capacitor $C_{FB}$ which are connected to each other through the m-th sensing line SSLm, are charge-shared with each other.

The storage capacitor $C_{ST}$ receives the swing voltage (V0) from the line-capacitor CD_Line, and stores a voltage (V0−V1) between the swing voltage (V0) and the initial voltage V1. The feedback capacitor $C_{FB}$ stores a voltage corresponding to a potential difference between the threshold voltage (VTH) previously stored in the storage capacitor $C_{ST}$ and the voltage (V0−V1) currently stored in the storage capacitor $C_{ST}$.

The output voltage (VOUT) of the amplifier A may be defined by the following Equation 2.

$$dQCST=dQCFB$$

$$dQCST=CST\times VTH-CST\times(V0-V1)$$

$$dVQCFB=V1-V0+VTH$$

$$dQCFB=CFB\times(V1-VOUT)$$

$$VOUT=V1+(V1-V0+VTH)=2V1-V0+VTH \quad \text{[Equation 2]}$$

In Equation 2, dQCST denotes amount of charge change of the storage capacitor $C_{ST}$, dQCFB denotes amount of charge change of the feedback capacitor $C_{FB}$, CST denotes a capacity of the storage capacitor $C_{ST}$ and CFB denotes a capacity of a feedback capacitor $C_{FB}$.

The first capacitor C1 stores the output voltage (VOUT) of the amplifier A.

Then, referring to FIG. 7B, the data-sensing circuit 130*k* turns on the ninth switch SW9 of the fifth selector 135 and turns off remaining switches SW1, SW2, SW3, SW4, SW5, SW6, SW7 and SW8.

Thus, the output voltage (VOUT) stored in the first capacitor C1 is stored in the second capacitor C2 and is applied to the converter ADC.

The converter ADC converts the output voltage (VOUT) to sensing data and outputs the sensing data.

Hereinafter, alternative exemplary embodiments of the invention will be described. The same reference numerals are used to refer to the same or like parts as those in the exemplary embodiments described above, and any repetitive detailed description thereof will be simplified or omitted.

Figure 11:
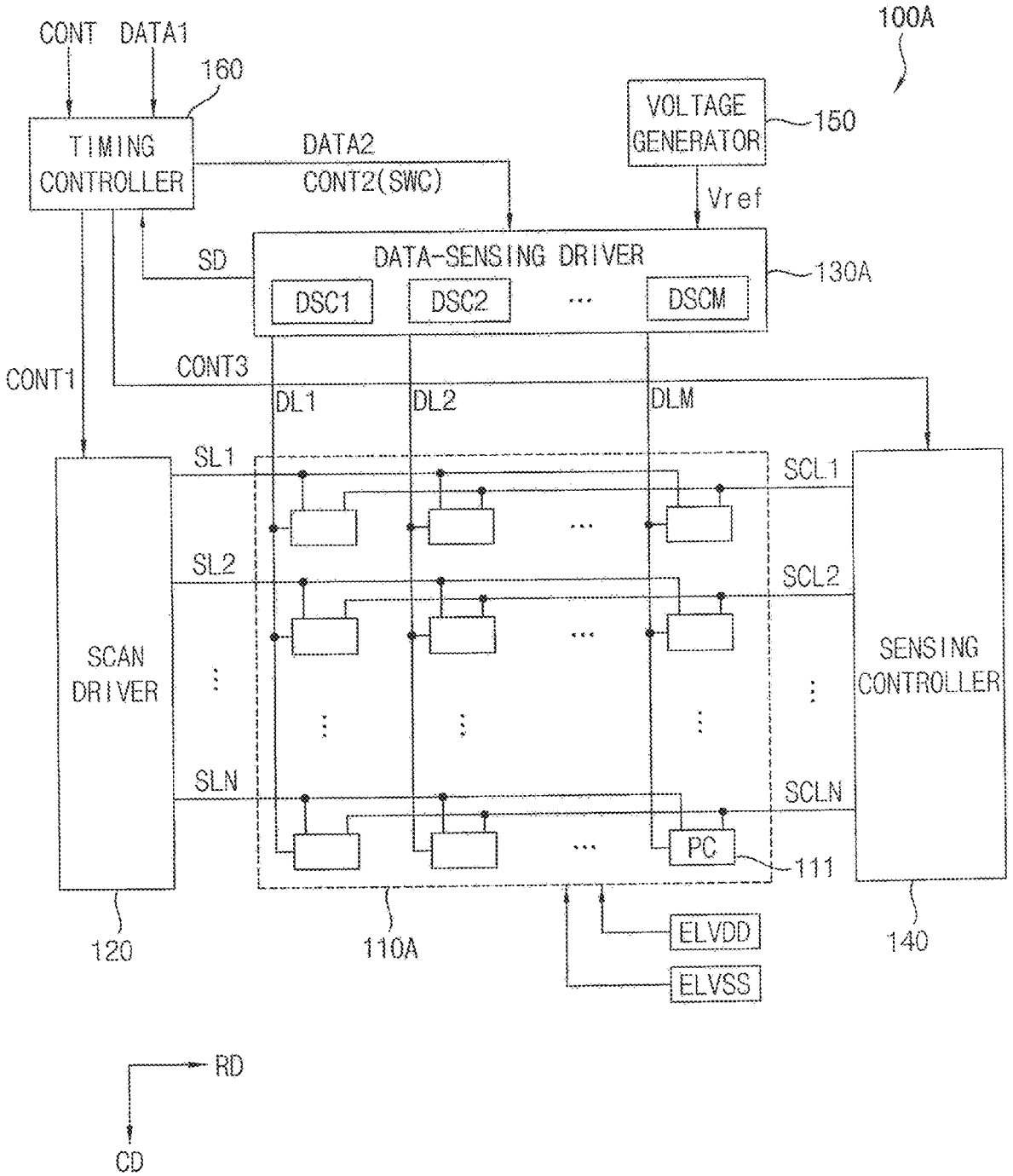
FIG. 11 is a block diagram illustrating an organic light-emitting display device according to an alternative exemplary embodiment.

FIG. 11 is a block diagram illustrating an organic light-emitting display device according to an alternative exemplary embodiment.

Referring to FIG. 11, the organic light-emitting display device 100A may be substantially the same as the organic light-emitting display device 100 shown in FIG. 1 except for a display panel 110A and a data-sensing driver 130A.

In an exemplary embodiment, the display panel 110A may include a plurality of scan lines SL1, SL2 and SLN, a plurality of data lines DL1, DL2 and DLM, a plurality of sensing control lines SCL1, SCL2 and SCLN and a plurality of pixels 111 (here, 'N' and 'M' are natural number that is equal to or more than 2).

In an exemplary embodiment, the plurality of data lines DL1, DL2 and DLM drives or functions as the plurality of sensing lines in a sensing period. Thus, the display panel 110A may omits the plurality of sensing lines SSL1, SSL2 and SSLm of an exemplary embodiment of the organic light-emitting display device 100 described above referring to FIG. 1.

The data-sensing driver 130A may include a plurality of data-sensing circuits DSC1, DSC2 and DSCM which is connected to the plurality of data lines DL1, DL2 and DLM.

A data-sensing circuit is connected to the data line, and the data sensing circuit is configured to output a data voltage to the data line in an emission period in which the organic light-emitting diode in the pixel circuit emits light to display an image, and configured to readout a sensing signal from the data line in a sensing period in which a degradation of the pixel circuit is sensed. The data-sensing circuit may include an amplifier. The amplifier may operate or be used in the emission period and the sensing period.

Figure 12:
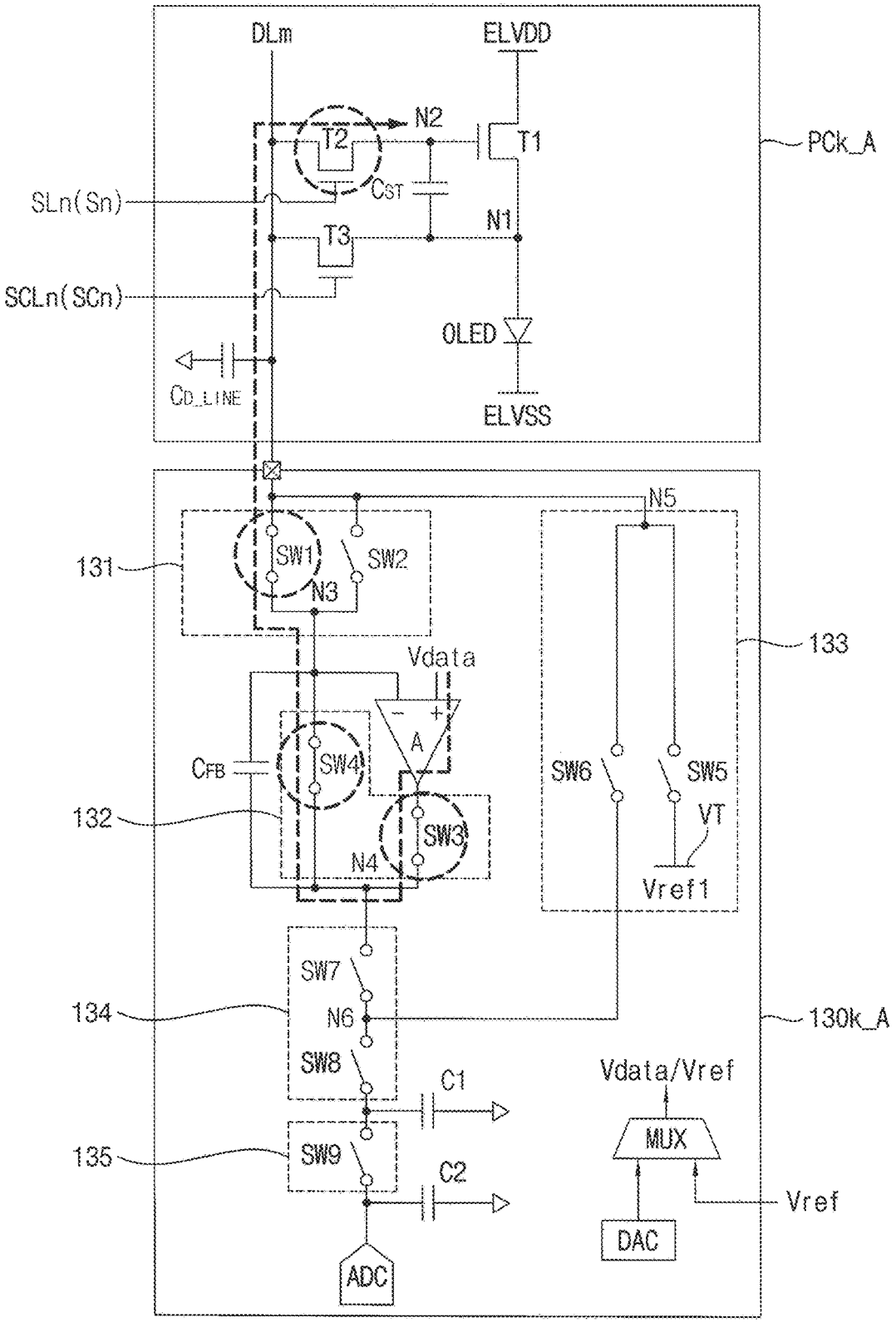
FIG. 12 is a conceptual diagram illustrating an emission period in a display period according to an alternative exemplary embodiment.

FIG. 12 is a conceptual diagram illustrating an emission period in a display period according to an alternative exemplary embodiment.

Referring to FIGS. 11 and 12, an exemplary embodiment of the organic light-emitting display device may include a pixel circuit PCk_A and a data-sensing circuit 130*k*_A connected to the pixel circuit PCk_A.

The pixel circuit PCk_A may include a driving transistor T1, a storage capacitor $C_{ST}$, a switching transistor T2, an organic light-emitting diode OLED and a sensing transistor T3.

The switching transistor T2 includes a control electrode connected to the n-th scan line SLn, a first electrode connected to the m-th data line DLm and a second electrode connected to a second node N2. The switching transistor T2 may be turned on in response to an ON voltage of an n-th scan signal Sn applied to the n-th scan line SLn.

The storage capacitor $C_{ST}$ may include a first electrode connected to the second node N2 and a second electrode connected to a first node N1. The storage capacitor $C_{ST}$ may store a voltage corresponding to the data voltage Vdata applied to the m-th data line DLm.

The driving transistor T1 includes a control electrode connected to the second node N2, a first electrode to which the first power source voltage ELVDD is applied and a second electrode connected to the first node N1. The driving transistor T1 is configured to provide the organic light-emitting diode OLED with a current corresponding to a voltage stored in the storage capacitor $C_{ST}$.

The organic light-emitting diode OLED may include an anode electrode connected to the first node N1 and a cathode electrode to which a second power source voltage ELVSS is applied. The organic light-emitting diode OLED may emit the light corresponding to a current flowing between the first node N1 and the second power source voltage ELVSS.

The sensing transistor T3 includes a control electrode connected to the n-th sensing control line SCLn, a first electrode connected to the m-th data line DLm and a second electrode connected to the first node N1. The sensing transistor T3 is connected between the m-th data line DLm and the first node N1, and is turned on in response to an ON voltage of the n-th sensing control signal SCn applied to the n-th sensing control line SCLn.

In an exemplary embodiment, the data-sensing circuit 130*k*_A may include a first selector 131, an amplifier A, feedback capacitor $C_{FB}$, a second selector 132, a third selector 133, a first capacitor C1, a fourth selector 134, a fifth selector 135, a second capacitor C2 and a converter ADC. The data-sensing circuit 130*k*_A may further include a digital-to-analog converter DAC and a multiplexer MUX.

The first selector 131 may selectively connect the m-th data line DLm to a third node N3.

The first selector 131 may include a first switch SW1 and a second switch SW2. The first switch SW1 is connected between the m-th data line DLm and the third node N3. The second switch SW2 is connected between the m-th data line DLm and the third node N3.

The amplifier A may include a first input terminal (−), a second input terminal (+) and an output terminal. The first input terminal (−) is connected to the third node N3, the second input terminal (+) is connected to the multiplexer MUX and the output terminal is connected to the second selector 132, e.g., a third switch SW3 therein. The multiplexer MUX selectively outputs the data voltage Vdata provided from the digital-to-analog converter DAC and the plurality of reference voltages Vref provided from the voltage generator 150 to the second input terminal (+) of the amplifier A.

In one exemplary embodiment, for example, the second input terminal (+) of the amplifier A is configured to receive the data voltage Vdata in the emission period. In such an embodiment, the second input terminal (+) of the amplifier A is configured to receive a second reference voltage Vref2 in the sensing period.

The feedback capacitor $C_{FB}$ is connected between the first input terminal (−) and the output terminal of the amplifier A.

The second selector 132 may include the third switch SW3 and a fourth switch SW4.

The third switch SW3 is connected between the output terminal of the amplifier A and a fourth node N4. The fourth switch SW4 is connected between the fourth node N4 and the third node N3.

The third selector 133 selectively connects the first selector 131 to the fourth selector 134, e.g., a sixth node N6 therein, or a first reference voltage Vref1.

The third selector 133 may include a fifth switch SW5 and a sixth switch SW6. The fifth switch SW5 is connected between a voltage terminal VT to which the first reference voltage Vref1 is applied and the fifth node N5. The sixth switch SW6 is connected between the fifth node N5 and the sixth node N6 in the fourth selector 134.

The first capacitor C1 stores a sensing signal. The first capacitor C1 is connected between the fourth selector 134 and a ground.

The fourth selector 134 selectively connects the output terminal of the amplifier A (e.g., via the second selector 132) and the third selector 133 to the first capacitor C1.

The fourth selector 134 may include a seventh switch SW7 and an eighth switch SW8.

The seventh switch SW7 is connected between the second selector 132 and the third selector 133. The seventh switch SW7 is connected between the fourth node N4 and the sixth node N6. The eighth switch SW8 is connected between the seventh switch SW7 and the first capacitor C1.

The fifth selector 135 selectively connects the first capacitor C1 to the converter ADC. The fifth selector 135 may include a ninth switch SW9.

The ninth switch SW9 is connected between the first capacitor C1 and the converter ADC.

The converter ADC is connected to the fifth selector 135 and a second capacitor C2. The second capacitor C2 is connected between the converter ADC and the ground. The converter ADC is configured to convert the sensing signal stored in the second capacitor C2 to sensing data and output the sensing data.

Hereinafter, operations of driving the pixel circuit PCk_A and the data-sensing circuit 130*k*_A in the emission period ACT_EM of the frame period will be described in detail.

The data-sensing circuit 130*k*_A receives the data voltage Vdata through the second input terminal (+) of the amplifier A.

In the emission period ACT_EM of the frame period, the data-sensing circuit 130*k*_A turns on the first switch SW1 of the first selector 131, and the third and fourth switches SW3 and SW4 of the second selector 132, and the data-sensing circuit 130*k*_A turns off remaining switches SW2, SW5, SW6, SW7, SW8 and SW9. Thus, the data-sensing circuit 130*k*_A outputs the data voltage Vdata to the m-th data line DLm.

The pixel circuit PCk_A receives the data voltage Vdata through the m-th data line DLm and the n-th scan signal Sn through the n-th scan line SLn.

In the pixel circuit PCk_A, the switching transistor T2 is turned on in response to an ON voltage of the n-th scan signal Sn. When the switching transistor T2 is turned on, the storage capacitor $C_{ST}$ stores a voltage corresponding to the data voltage Vdata applied to the m-th data line DLm.

The driving transistor T1 provides the organic light-emitting diode OLED with a driving current corresponding to the voltage stored in the storage capacitor $C_{ST}$. The organic light-emitting diode OLED may emit the light corresponding to the driving current. Thus, the organic light-emitting diode OLED may display an image.

According to an exemplary embodiment, the sensing period may include an initializing period and a signal sensing period. In the initializing period, a gate/source voltage (VGS) of the driving transistor T1 is formed in the pixel circuit and the data line is initialized. In the signal sensing period, the sensing signal which is the threshold voltage of the driving transistor or the driving current of the organic light-emitting diode OLED is sensed from the pixel circuit.

Figure 13:
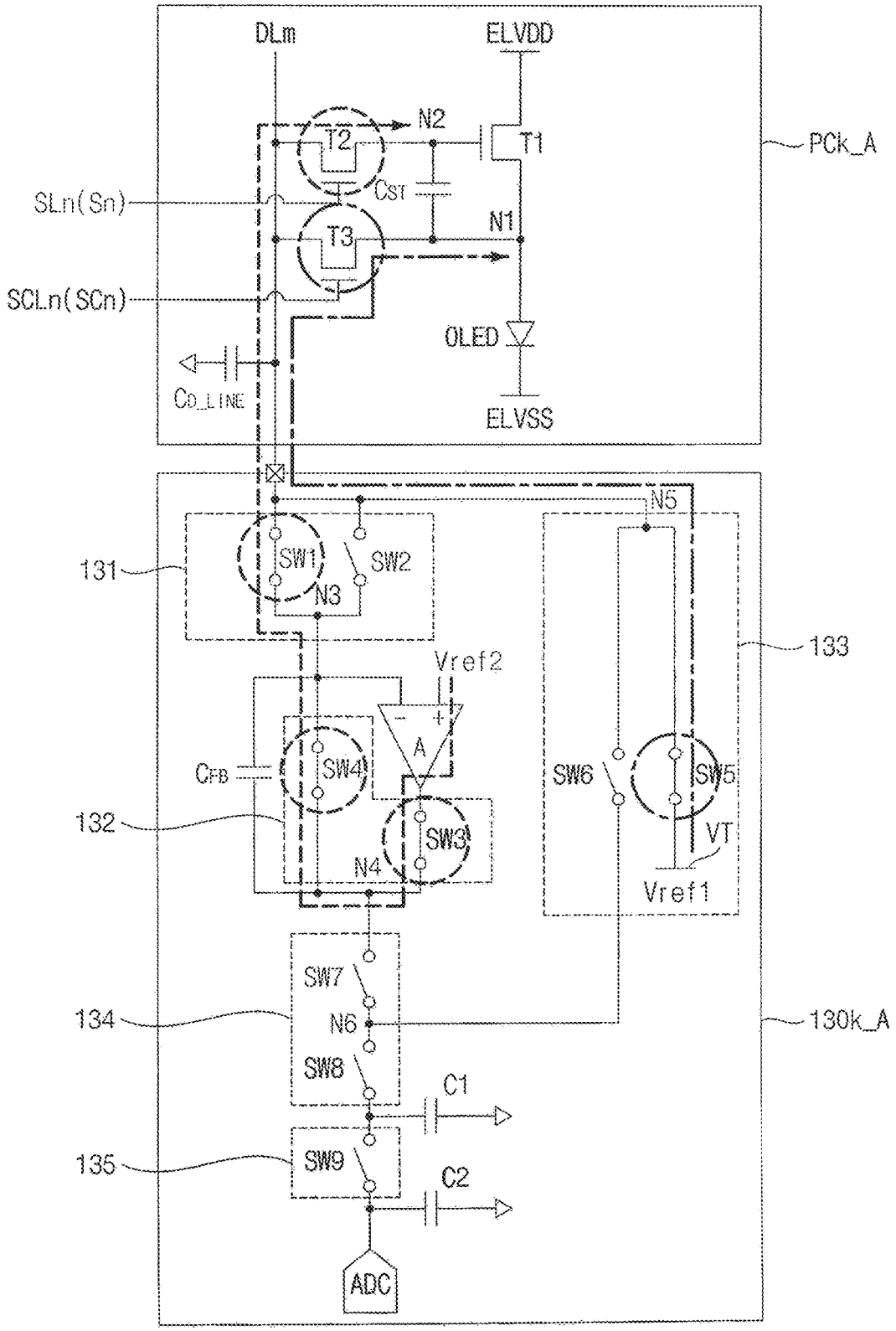
FIG. 13 is a conceptual diagram illustrating an initialization method in a sensing period according to an alternative exemplary embodiment.

FIG. 13 is a conceptual diagram illustrating an initialization method in a sensing period according to an alternative exemplary embodiment.

Referring to FIG. 13, the data-sensing circuit 130*k*_A forms the gate/source voltage (VGS) of the driving transistor T1 in the pixel circuit PCk_A and initializes the m-th data line DLm.

In a first period of the sensing period, the data-sensing circuit 130*k*_A receives the second reference voltage Vref2 from the second input terminal (+) of the amplifier A.

In such an embodiment, the data-sensing circuit 130*k*_A turns on the first switch SW1 of the first selector 131 and the third and fourth switches SW3 and SW4 of the second selector 132, and the data-sensing circuit 130*k*_A turns off remaining switches SW2, SW5, SW6, SW7, SW8 and SW9. Thus, the second reference voltage Vref2 applied to the second input terminal (+) of the amplifier A is applied to the m-th data line DLm.

In the pixel circuit PCk_A, the switching transistor T2 is turned on in response to the ON voltage of the n-th scan signal Sn, and the sensing transistor T3 is turned off in response to the OFF voltage of the n-th sensing control signal SCn. The second reference voltage Vref2 applied to the m-th data line DLm is applied to the control electrode of the driving transistor T1. The driving transistor T1 is turned on based on the second reference voltage Vref2.

Then, in a second period of the sensing period, the data-sensing circuit 130*k*_A receives the first reference voltage Vref1 through the voltage terminal VT of the third selector 133.

In such an embodiment, the data-sensing circuit 130*k*_A turns on the fifth switch SW5 of the third selector 133, and the data-sensing circuit 130*k*_A turns off remaining switches SW1, SW2, SW3, SW4, SW6, SW7, SW8 and SW9. Thus, the first reference voltage Vref1 received from the voltage terminal VT is applied to the m-th data line DLm.

In the pixel circuit PCk_A, the sensing transistor T3 is turned on in response to the ON voltage of the n-th sensing control signal SCn and the switching transistor T2 is turned off in response to the OFF voltage of the n-th scan signal Sn. The first node N1 receives a voltage corresponding to the first reference voltage Vref1.

The storage capacitor $C_{ST}$ may store a voltage corresponding to a potential difference (Vref1−Vref2) between the first reference voltage Vref1 and the second reference voltage Vref2.

Thus, a gate/source voltage (VGS=Vref1−Vref2) of the driving transistor T1 may be formed, such that the m-th data line DLm may be initialized.

Hereinafter, an exemplary embodiment where the sensing period is defined in the power-off period will be described in detail.

Figure 14A:
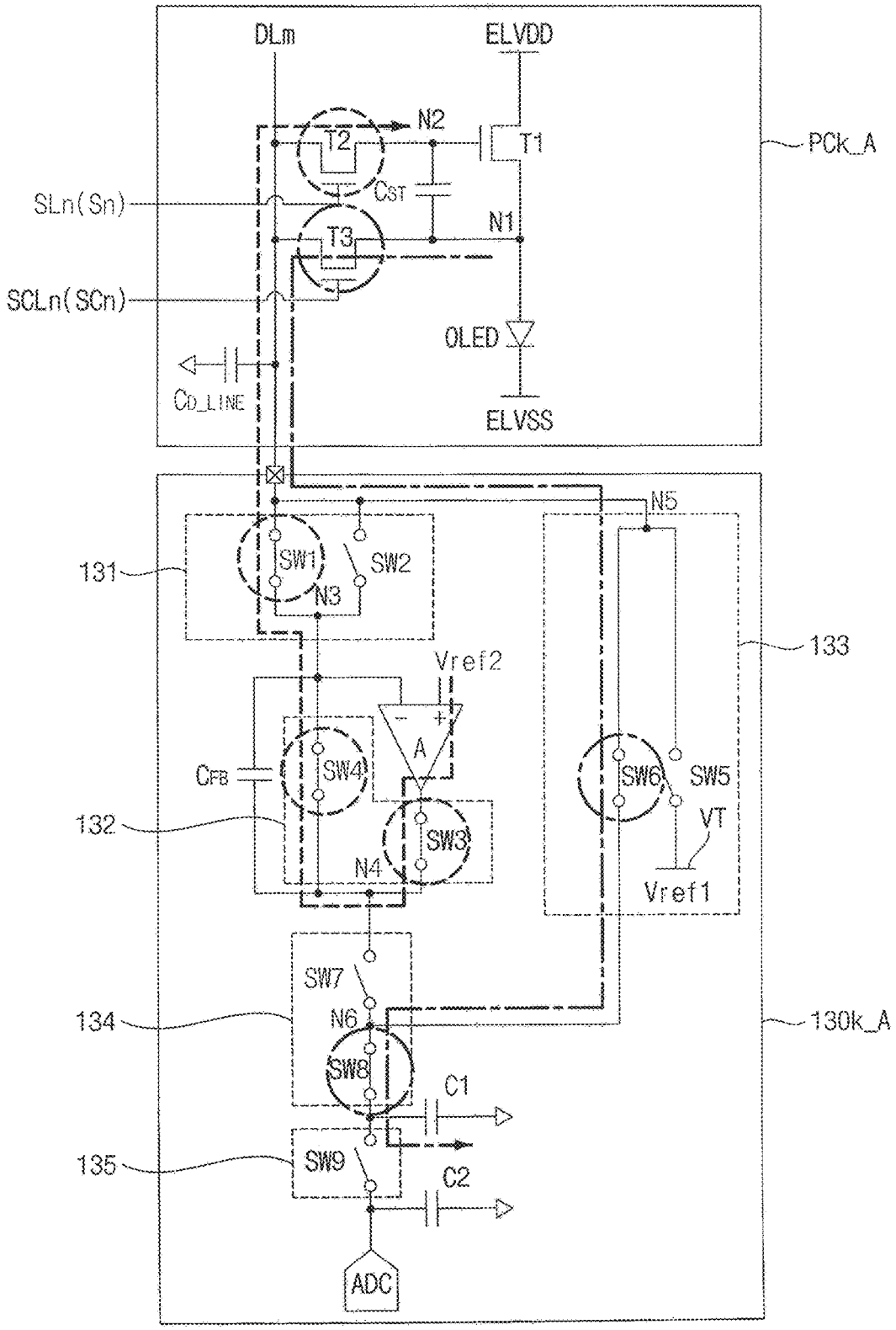
FIGS. 14A and 14B are conceptual diagrams illustrating a voltage-sensing method in a power-off period according to an alternative exemplary embodiment.
Figure 14B:
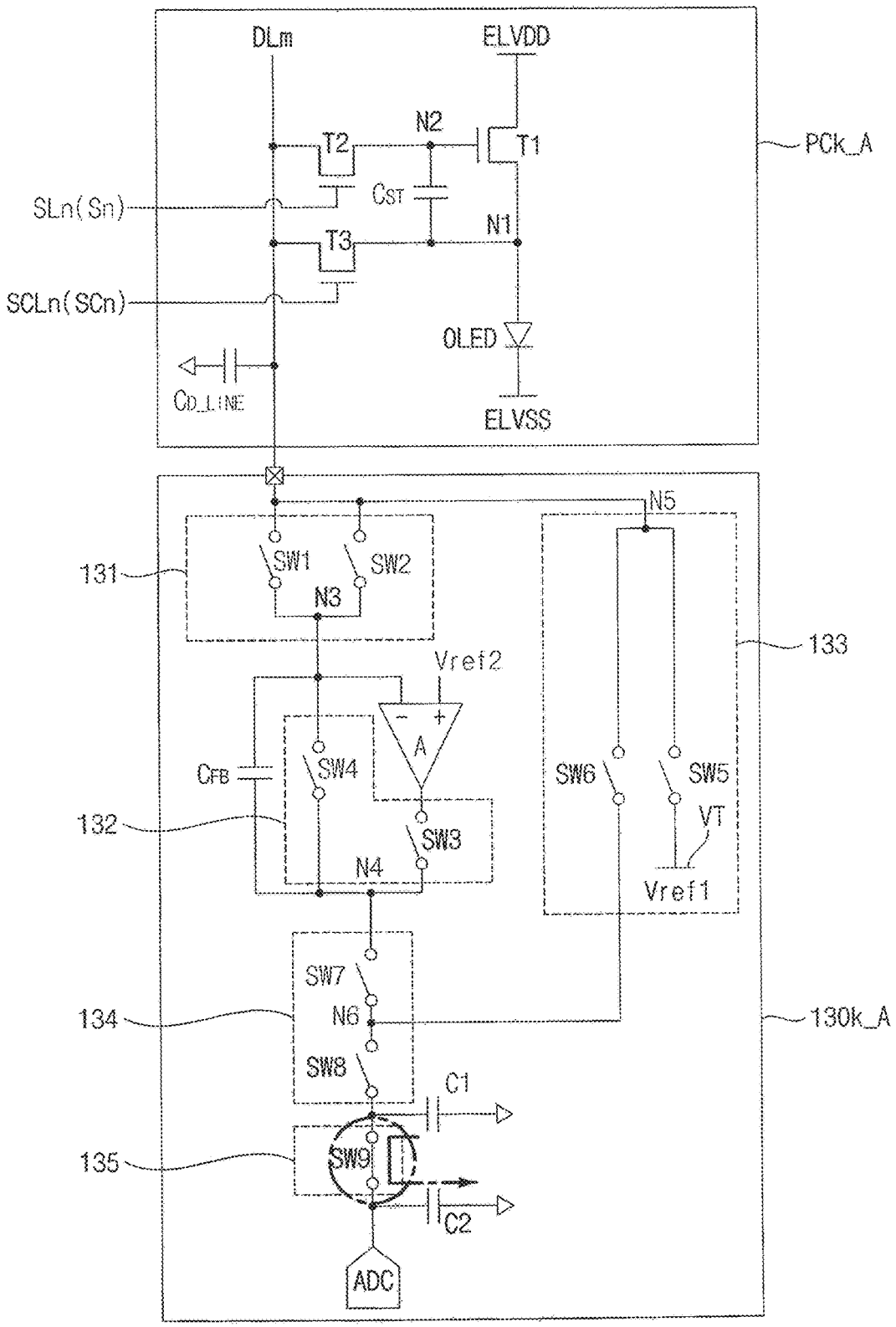

FIGS. 14A and 14B are conceptual diagrams illustrating a voltage-sensing method in a power-off period according to an alternative exemplary embodiment.

Referring to FIG. 14A, a voltage-sensing operation for sensing a sensing voltage by the data-sensing circuit 130*k*_A and the pixel circuit PCk_A will hereinafter be described. After forming the gate/source voltage (VGS) and initializing the data line as described above referring to FIG. 13, the voltage-sensing operation may be performed.

In a first period of the sensing period, the data-sensing circuit 130*k*_A receives the second reference voltage Vref2 through the second input terminal (+) of the amplifier A.

In such an embodiment, the data-sensing circuit 130*k*_A turns on the first switch SW1 of the first selector 131 and the third and fourth switches SW3 and SW4 of the second selector 132, and the data-sensing circuit 130*k*_A turns off remaining switches SW2, SW5, SW6, SW7, SW8 and SW9. Thus, the second reference voltage Vref2 applied to the second input terminal (+) of the amplifier A is applied to the m-th data line DLm.

In the pixel circuit PCk_A, the switching transistor T2 is turned on in response to the ON voltage of the n-th scan signal Sn and the sensing transistor T3 is turned off in response to the OFF voltage of the n-th sensing control signal SCn. The second reference voltage Vref2 applied to the m-th data line DLm is applied to the control electrode of the driving transistor T1. The driving transistor T1 is turned on based on the second reference voltage Vref2. The first node N1 connected to the second electrode of the driving transistor T1 receives a sensing voltage corresponding to the threshold voltage (VTH) of the driving transistor T1.

Then, in a second period of the sensing period, the data-sensing circuit 130*k*_A turns on the sixth switch SW6 of the third selector 133 and the eighth switch SW8 of the fourth selector 134, and the data-sensing circuit 130*k*_A turns off remaining switches SW1, SW2, SW3, SW4, SW5, SW7 and SW9.

The switching transistor T2 is turned off in response to the OFF voltage of the n-th scan signal Sn, and the sensing transistor T3 is turned on in response to the ON voltage of the n-th sensing control signal SCn. When the sensing transistor T3 is turned on, the m-th data line DLm receives a voltage corresponding to the threshold voltage (VTH) applied to the first node N1.

The sensing voltage is stored in the first capacitor C1 through the m-th data line DLm and the fourth selector 134.

Referring to FIG. 14B, the data-sensing circuit 130*k*_A turns on the ninth switch SW9 of the fifth selector 135, and the data-sensing circuit 130*k*_A turns off remaining switches SW1, SW2, SW3, SW4, SW5, SW6, SW7 and SW8.

Thus, the output voltage (VOUT) stored in the first capacitor C1 is stored in the second capacitor C2 and is applied to the converter ADC.

The converter ADC converts the output voltage (VOUT) to sensing data and outputs the sensing data.

Figure 15:
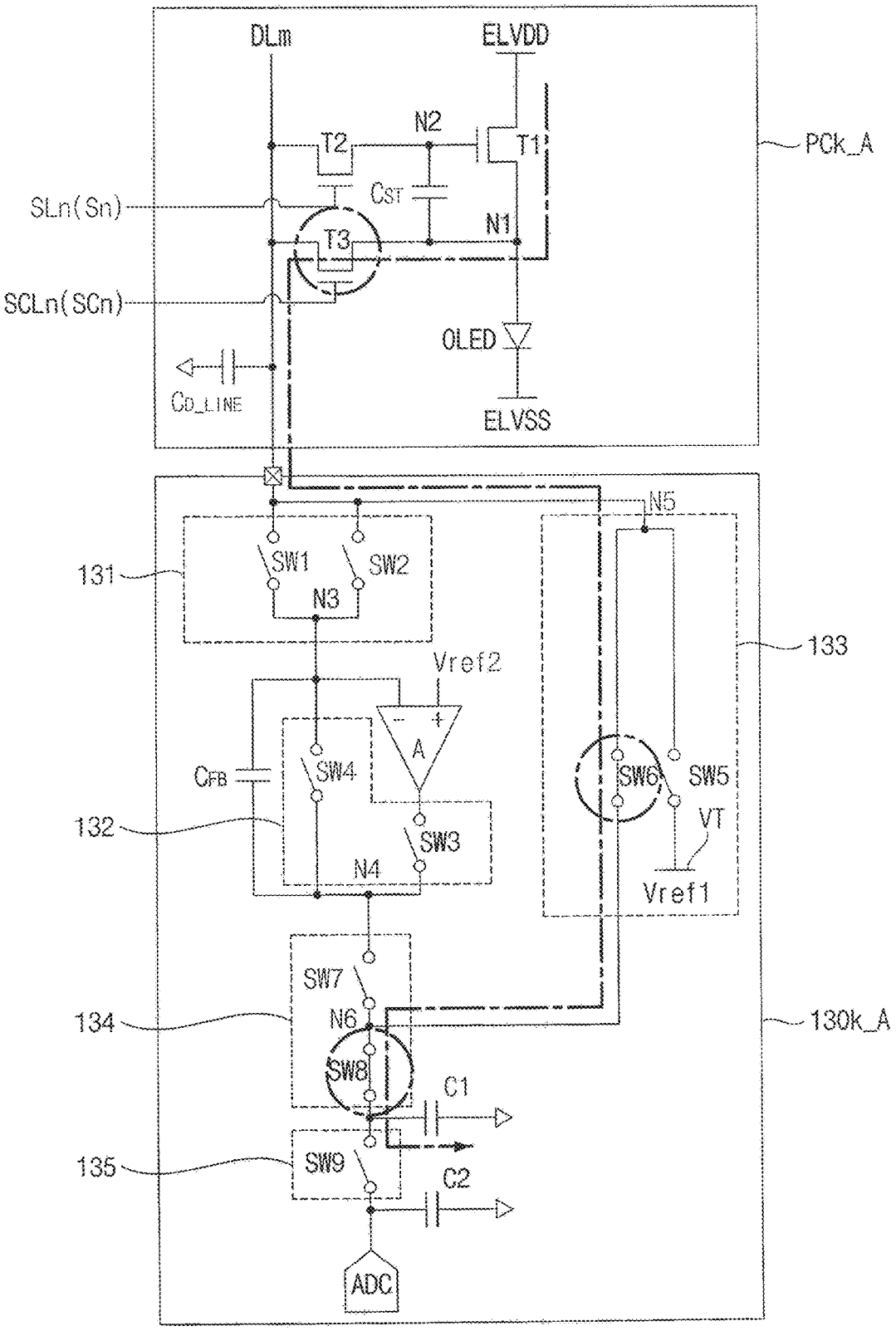
FIG. 15 is a conceptual diagram illustrating a current-sensing method in a power-off period according to an alternative exemplary embodiment.

FIG. 15 is a conceptual diagram illustrating a current-sensing method in a power-off period according to an alternative exemplary embodiment.

Referring to FIG. 15, a current-sensing operation for sensing a sensing current by the data-sensing circuit 130*k*_A and the pixel circuit PCk_A will hereinafter be described. After forming the gate/source voltage (VGS) and initializing the data line as described above referring to FIG. 13, the current-sensing operation may be performed.

In such an embodiment, the data-sensing circuit 130*k*_A turns on the sixth switch SW6 of the third selector 133 and the eighth switch SW8 of the fourth selector 134, and the data-sensing circuit 130*k*_A turns off remaining switches SW1, SW2, SW3, SW4, SW5, SW7 and SW9.

In the pixel circuit PCk_A, the driving transistor T1 is turned on based on a voltage (Vref2) stored in the storage capacitor $C_{ST}$, and a driving current flows into the first node N1 connected to the anode electrode of the organic light-emitting diode OLED.

The sensing transistor T3 is turned on in response to the ON voltage of the n-th sensing control signal SCn. When the sensing transistor T3 is turned on, the driving current applied to the first node N1 is stored in the first capacitor C1 through the m-th data line DLm and the fourth selector 134. The first capacitor C1 stores a sensing voltage corresponding to the driving current.

Then, referring to FIG. 14B, the data-sensing circuit 130*k*_A turns on the ninth switch SW9 of the fifth selector 135, and the data-sensing circuit 130*k*_A turns off remaining switches SW1, SW2, SW3, SW4, SW5, SW6, SW7 and SW8.

Thus, the sensing voltage stored in the first capacitor C1 is stored in the second capacitor C2 and is applied to the converter ADC.

The converter ADC converts the sensing voltage to sensing data and outputs the sensing data.

Hereinafter, in an exemplary embodiment, the sensing period may be defined in the display period. The display period includes a vertical blank period, and the vertical blank period includes the sensing period. The sensing period includes the initializing period and the signal sensing period as described above referring to FIG. 13. The sensing signal may correspond to the threshold voltage and the driving current of the organic light-emitting diode OLED. The signal sensing period may include a voltage-sensing period, in which the threshold voltage is sensed, and a current-sensing period, in which the driving current is sensed.

Figure 16A:
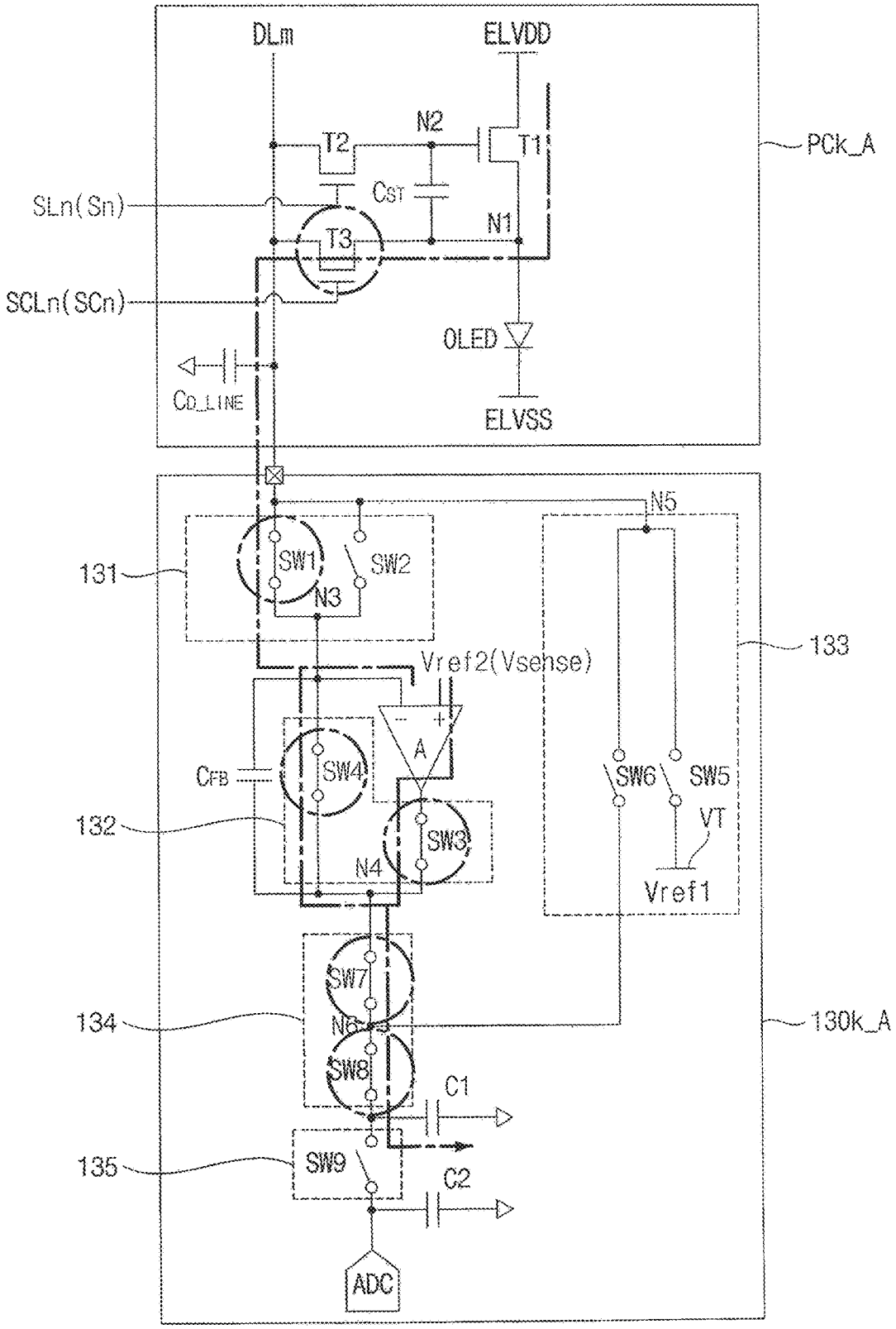
FIGS. 16A and 16B are conceptual diagrams illustrating a fast current-sensing method in a display period according to an alternative exemplary embodiment.
Figure 16B:
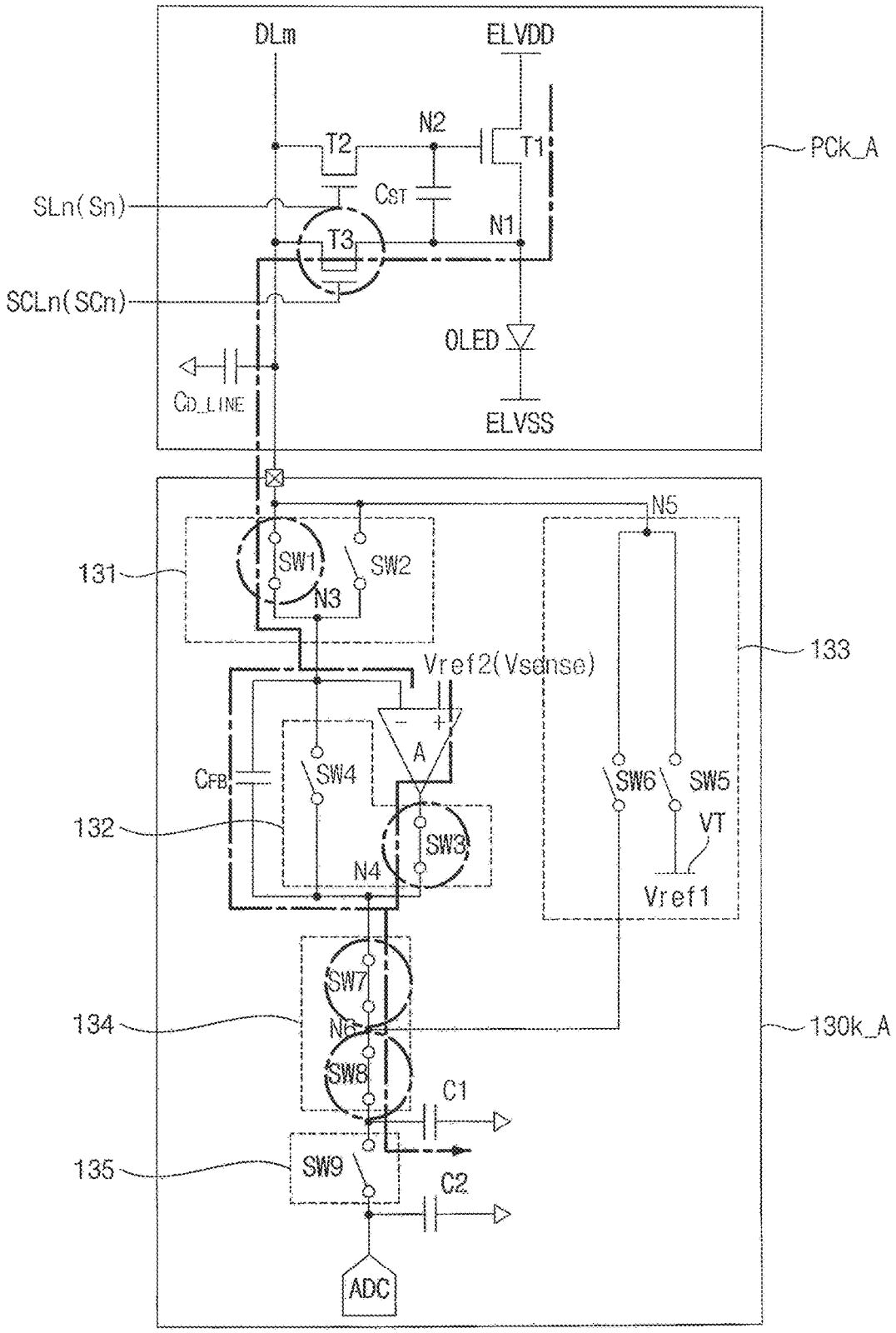

FIGS. 16A and 16B are conceptual diagrams illustrating a fast current-sensing method in a display period according to an alternative exemplary embodiment.

According to an exemplary embodiment, a fast current-sensing operation in the display period may include resetting the amplifier and sensing the driving current. After forming the gate/source voltage (VGS) and initializing the data line as described above referring to FIG. 13, the data-sensing circuit 130*k*_A and the pixel circuit PCk_A perform the fast current-sensing operation.

Referring to FIG. 16A, the data-sensing circuit 130*k*_A resets the amplifier A and the feedback capacitor $C_{FB}$.

In one exemplary embodiment, for example, the data-sensing circuit 130*k*_A receives a second reference voltage Vref2 having a voltage level (Vsense) through the second input terminal (+) of the amplifier A.

In such an embodiment, the data-sensing circuit 130*k*_A turns on the first switch SW1 of the first selector 131, the third and fourth switches SW3 and SW4 of the second selector 132 and the seventh and eighth switches SW7 and SW8 of the fourth selector 134, and the data-sensing circuit 130*k*_A turns off remaining switches SW2, SW5, SW6 and SW9.

In the pixel circuit PCk_A, the switching transistor T2 is turned off in response to the OFF voltage of the n-th scan signal Sn, and the sensing transistor T3 is turned on in response to the ON voltage of the n-th sensing control signal SCn. The driving transistor T1 is turned on based on a voltage stored in the storage capacitor $C_{ST}$ in the initializing period described above referring to FIG. 13.

Thus, a current may flow between the driving transistor T1, the m-th data line DLm, the amplifier A, the first capacitor C1 and the ground.

Thus, the amplifier A may be reset. In such an embodiment, both terminals of the feedback capacitor $C_{FB}$, which is connected between the input terminal and the output terminal of the amplifier A, receive a same voltage as each other and thus, the feedback capacitor $C_{FB}$ may be reset.

Then, referring to FIG. 16B, the data-sensing circuit 130*k*_A may sense the driving current flowing into the organic light-emitting diode OLED in the pixel circuit PCk_A.

In one exemplary embodiment, for example, the data-sensing circuit 130*k*_A receives a second reference voltage Vref2 having a voltage level (Vsense) through the second input terminal (+) of the amplifier A.

In such an embodiment, the data-sensing circuit 130*k*_A turns on the first switch SW1 of the first selector 131, the third switch SW3 of the second selector 132 and the seventh and eighth switches SW7 and SW8 of the fourth selector 134, and the data-sensing circuit 130*k*_A turns off remaining switches SW2, SW4, SW5, SW6 and SW9.

In the pixel circuit PCk_A, the switching transistor T2 is turned off in response to the OFF voltage of the n-th scan signal Sn, and the sensing transistor T3 is turned on in response to the ON voltage of the n-th sensing control signal SCn. When the sensing transistor T3 is turned on, a sensing current corresponding to the driving current, which flows into the organic light-emitting diode OLED, is applied to the amplifier A and the feedback capacitor $C_{FB}$.

The sensing current is integrated by the amplifier A and feedback capacitor $C_{FB}$, and an output voltage (VOUT) corresponding to the sensing current is outputted through the output terminal of the amplifier A.

The output voltage (VOUT) is stored in the first capacitor C1 through the fourth selector 134.

Then, referring to FIG. 14B, the data-sensing circuit 130*k*_A turns on the ninth switch SW9 of the fifth selector 135 and turns off remaining switches SW1, SW2, SW3, SW4, SW5, SW6, SW7 and SW8.

Thus, the output voltage (VOUT) stored in the first capacitor C1 is stored in the second capacitor C2 and is applied to the converter ADC.

The converter ADC converts the output voltage (VOUT) to sensing data and outputs the sensing data.

Figure 17A:
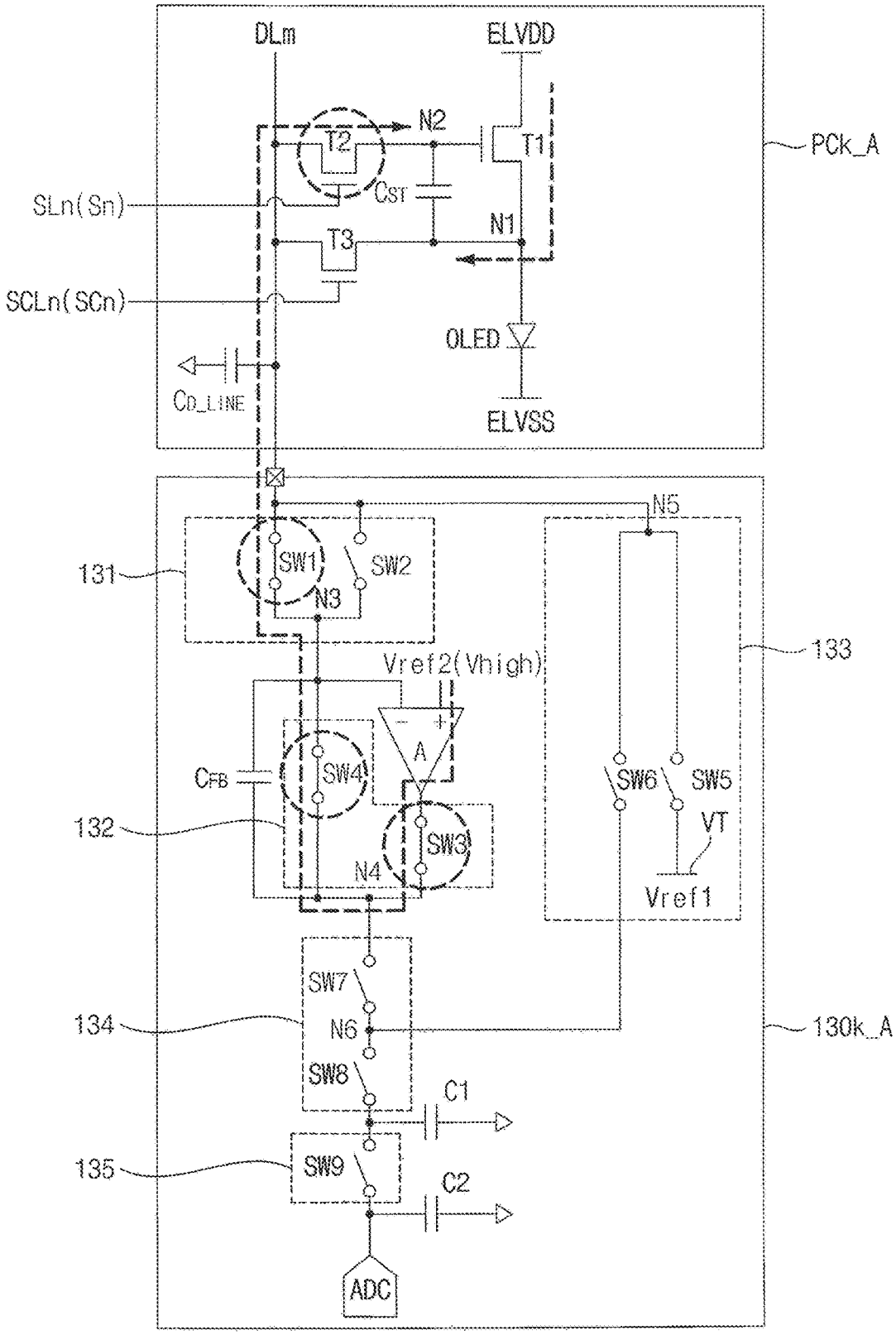
FIGS. 17A to 17C are conceptual diagrams illustrating a fast voltage-sensing method in a display period according to an alternative exemplary embodiment.
Figure 17B:
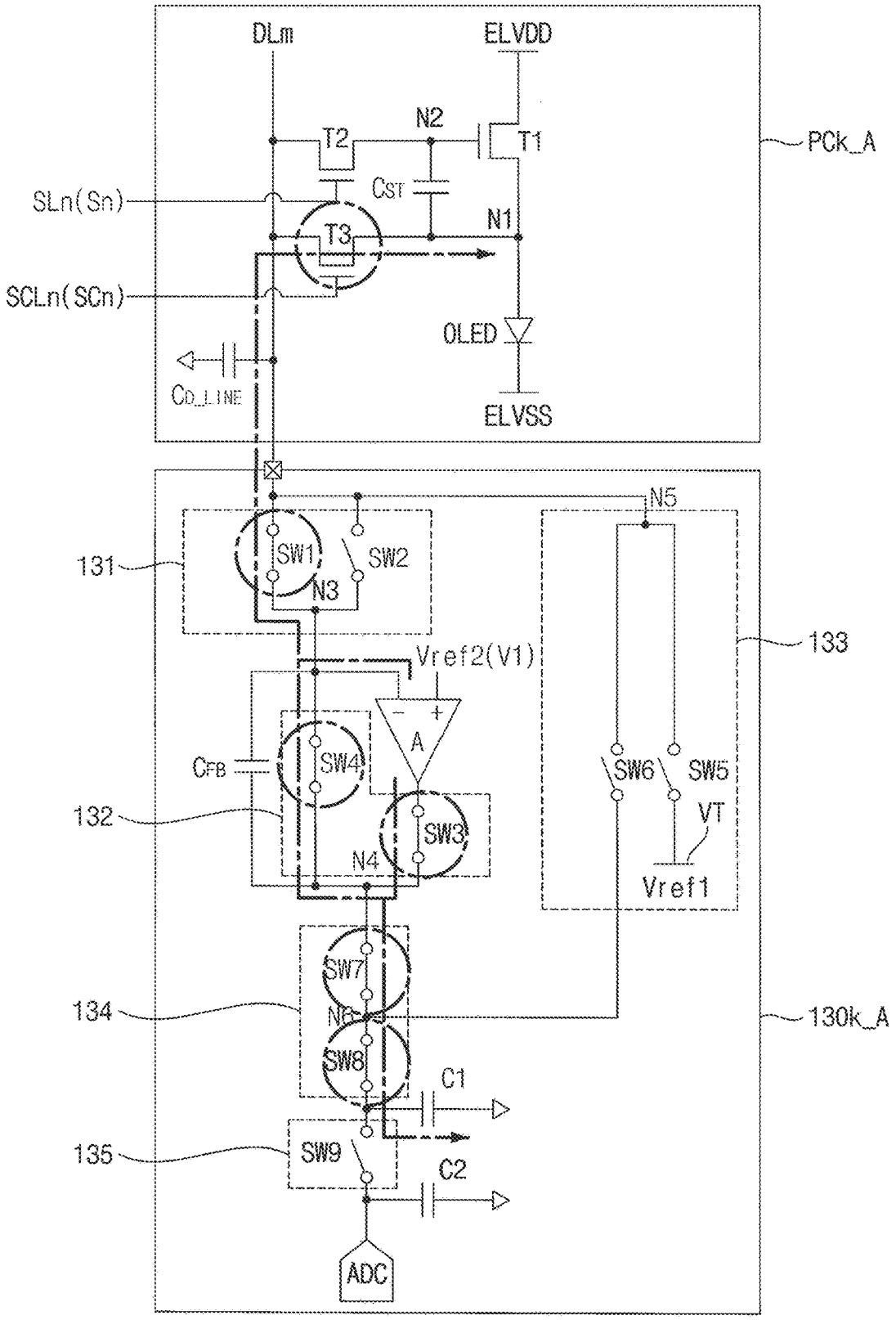
Figure 17C:
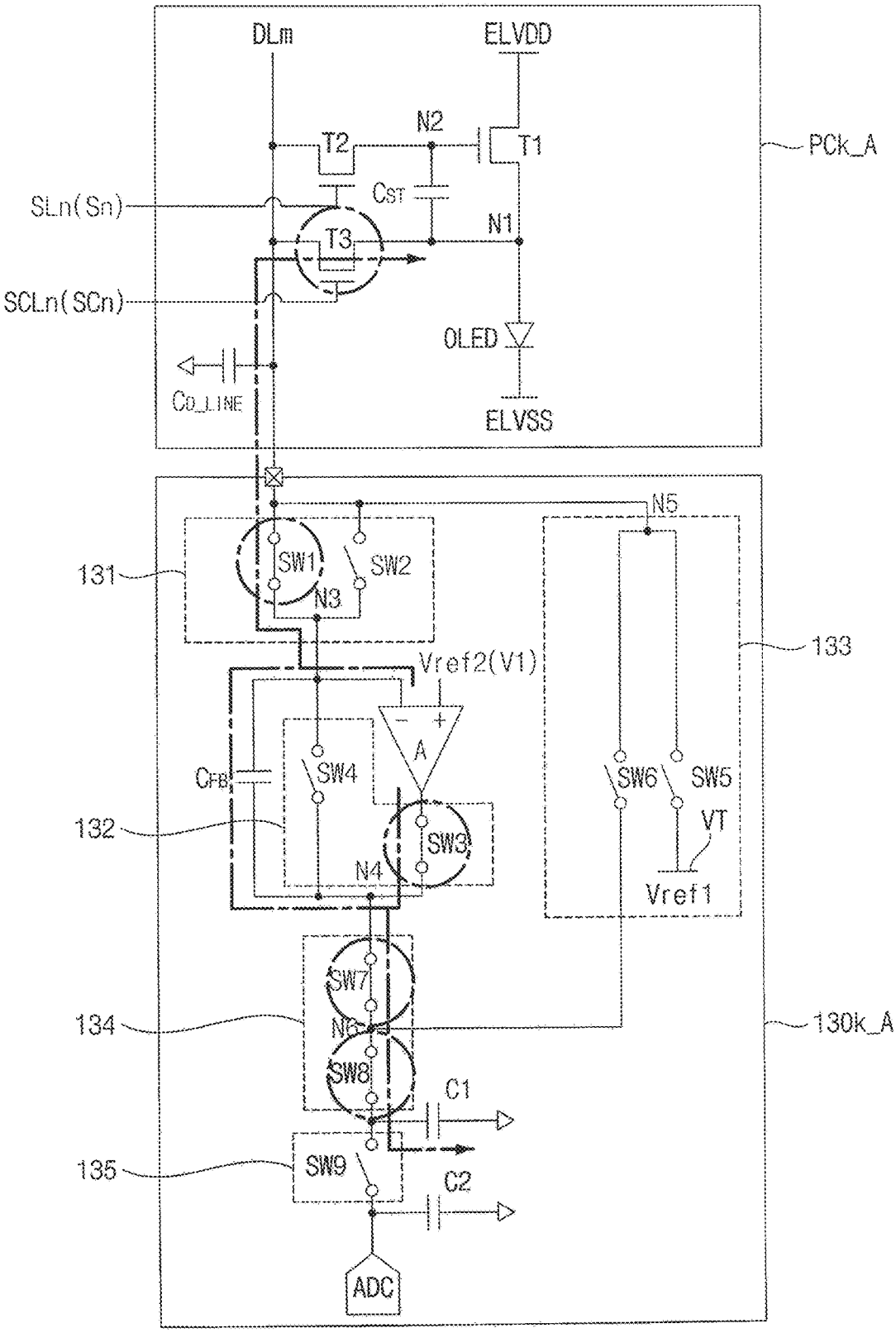

FIGS. 17A to 17C are conceptual diagrams illustrating a fast voltage-sensing method in a display period according to an alternative exemplary embodiment.

According to an exemplary embodiment, a fast voltage-sensing operation in the display period may include forming the threshold voltage, forming a swing voltage, initializing the data line by using the amplifier and sensing the threshold voltage. After forming the gate/source voltage (VGS) and initializing the data line as described above referring to FIG. 13, the data-sensing circuit 130*k*_A and the pixel circuit PCk_A perform the fast voltage-sensing operation.

Referring to FIG. 17A, in a first period in the display period, the data-sensing circuit 130*k*_A forms the threshold voltage (VTH) of the driving transistor T1 in the pixel circuit PCk_A.

In one exemplary embodiment, for example, the data-sensing circuit 130*k*_A receives a second reference voltage Vref2 having a high voltage level (Vhigh) through the second input terminal (+) of the amplifier A to form the threshold voltage (VTH).

In such an embodiment, the data-sensing circuit 130*k*_A turns on the first switch SW1 of the first selector 131 and the third and fourth switches SW3 and SW4 of the second selector 132, and the data-sensing circuit 130*k*_A turns off remaining switches SW2, SW5, SW6, SW7, SW8 and SW9. Thus, the high voltage (Vhigh) is applied to the m-th data line DLm through the amplifier A.

In the pixel circuit PCk_A, the switching transistor T2 is turned on in response to the ON voltage of the n-th scan signal Sn, and the sensing transistor T3 is turned off in response to the OFF voltage of the n-th sensing control signal SCn.

When the switching transistor T2 is turned on, a voltage corresponding to the high voltage (Vhigh) is applied to the control electrode of the driving transistor T1. The driving transistor T1 is turned on in response to the high voltage (Vhigh). The first node N1, which is connected to the second electrode of the driving transistor T1 and the anode electrode of the organic light-emitting diode OLED, receives a voltage corresponding to a potential difference (Vhigh−VTH) between the high voltage (Vhigh) and the threshold voltage (VTH). The gate/source voltage (VGS) of the driving transistor T1 may correspond to the threshold voltage (VTH).

Referring to FIG. 17B, in a second period in the display period, the data-sensing circuit 130*k*_A initializes the m-th data line DLm by using the amplifier A.

In one exemplary embodiment, for example, the data-sensing circuit 130*k*_A receives the second reference voltage Vref2 having an initial voltage level (V1) through the second input terminal (+) of the amplifier A to initial the m-th data line DLm.

In such an embodiment, the data-sensing circuit 130*k*_A turns on the first switch SW1 of the first selector 131, the third and fourth switches SW3 and SW4 of the second selector 132, the seventh and eighth switches SW7 and SW8 of the fourth selector 134, and the data-sensing circuit 130*k*_A turns off remaining switches SW2, SW5, SW6 and SW9.

In the pixel circuit PCk_A, the switching transistor T2 is turned off in response to the OFF voltage of the n-th scan signal Sn and the sensing transistor T3 is turned on in response to the ON voltage of the n-th sensing control signal SCn.

Thus, the second node N2 connected to the control electrode of the driving transistor T1 receives a voltage corresponding to a potential addition (V1+VTH) of the threshold voltage (VTH) and an initial voltage (V1), and the first node N1 connected to the second electrode of the driving transistor T1 receives the initial voltage (V1). Thus, the gate/source voltage (VGS) of the driving transistor T1 may correspond to the threshold voltage (VTH). The storage capacitor $C_{ST}$ may store the threshold voltage (VTH).

Both terminals of the feedback capacitor $C_{FB}$ connected between the output terminal and the first input terminal (−) of the amplifier A receive a same voltage as each other, such as the initial voltage (V1), and thus, the feedback capacitor $C_{FB}$ may be initialized.

In such an embodiment, the m-th data line DLm connected to the amplifier A may be initialized by the initial voltage (V1).

Referring to FIG. 17C, in a third period in the display period, the data-sensing circuit 130*k*_A senses the threshold voltage (VTH).

In the pixel circuit PCk_A, the switching transistor T2 is turned off in response to the OFF voltage of the n-th scan signal Sn, and the sensing transistor T3 is turned on in response to the ON voltage of the n-th sensing control signal SCn.

In such an embodiment, the data-sensing circuit 130*k*_A turns on the first switch SW1 of the first selector 131, the third switch SW3 of the second selector 132, the seventh and eighth switches SW7 and SW8 of the fourth selector 134, and the data-sensing circuit 130*k*_A turns off remaining switches SW2, SW4, SW5, SW6 and SW9.

When the sensing transistor T3 is turned on, the storage capacitor $C_{ST}$ is connected to the feedback capacitor $C_{FB}$ through the m-th data line DLm. The threshold voltage (VTH) stored in the storage capacitor $C_{ST}$ is applied to the feedback capacitor $C_{FB}$. The storage capacitor $C_{ST}$ and the feedback capacitor $C_{FB}$, which are connected to each other through the m-th data line DLm, are charge-shared with each other.

The first capacitor C1 stores the output voltage (VOUT) of the amplifier A through the fourth selector 134.

Then, referring to FIG. 14B, the data-sensing circuit 130*k*_A turns on the ninth switch SW9 of the fifth selector 135, and the data-sensing circuit 130*k*_A turns off remaining switches SW1, SW2, SW3, SW4, SW5, SW6, SW7 and SW8.

Thus, the output voltage (VOUT) stored in the first capacitor C1 is stored in the second capacitor C2 and is applied to the converter ADC.

The converter ADC converts the output voltage (VOUT) to sensing data and outputs the sensing data.

According to exemplary embodiments, the data-sensing driver may be simplified, and senses the sensing voltage and the sensing current from the pixel circuit in the power-off period or in the display period. In such embodiments, in the display period, the sensing voltage from the pixel circuit may quickly sense by charge-sharing of the storage capacitor and the feedback capacitor.

The invention should not be construed as being limited to the exemplary embodiments set forth herein. Rather, these exemplary embodiments are provided so that this disclosure will be thorough and complete and will fully convey the concept of the invention to those skilled in the art.

While the invention has been particularly shown and described with reference to exemplary embodiments thereof, it will be understood by those of ordinary skill in the art that various changes in form and details may be made therein without departing from the spirit or scope of the invention as defined by the following claims.

What is claimed is:

1. A data-sensing circuit for a pixel circuit that includes a switching transistor connected to a data line, a storage capacitor connected to the switching transistor, a driving transistor connected to the storage capacitor, an organic light-emitting diode connected to the driving transistor, and a sensing transistor connected between a sensing line and the driving transistor, the data-sensing circuit comprising:

a first selector connected to the data line and the sensing line;

a second selector connected to an output terminal of an amplifier, the first selector and a feedback capacitor, wherein the second selector selectively connects the output terminal of the amplifier to the first selector and the feedback capacitor;

a third selector connected to the sensing line; and a fourth selector connected to the output terminal of the amplifier and the third selector.

2. The data-sensing circuit of claim 1, wherein the second selector comprises:

a third switch connected between the output terminal of the amplifier and the feedback capacitor; and a fourth switch connected between the output terminal and a first input terminal of the amplifier, the first selector comprises:

a first switch connected between the data line and the fourth switch; and a second switch connected between the sensing line and the fourth switch, the third selector comprises:

a fifth switch connected between a voltage terminal and the sensing line; and a sixth switch connected between the sensing line and the fourth selector, and the fourth selector comprises:

a seventh switch connected between the second selector and the sixth switch; and an eighth switch connected between the seventh switch and a capacitor of the data-sensing circuit.

3. The data-sensing circuit of claim 2, wherein a sensing period comprises an initializing period, in which the pixel circuit is initialized, and a signal sensing period, in which a sensing signal formed in the pixel circuit is sensed, wherein, the switching transistor and the sensing transistor are turned on in the initializing period, the first, third, fourth and fifth switches are turned on in the initializing period, the second, sixth, seventh and eighth switches are turned off in the initializing period, the voltage terminal receives a first reference voltage in the initializing period, a second input terminal of the amplifier receives a second reference voltage in the initializing period, the first reference voltage is applied to an electrode of the driving transistor, in the initializing period and the second reference voltage is applied to a control electrode of the driving transistor in the initializing period.

4. The data-sensing circuit of claim 3, wherein the signal sensing period, in which a sensing voltage is sensed from the pixel circuit, is defined in a power-off period, the switching transistor and the sensing transistor are turned on in the signal sensing period, the first, third, fourth, sixth and eighth switches are turned on in the signal sensing period, the second, fifth and seventh switches are turned off in the signal sensing period, and a sensing signal corresponding a threshold voltage of the driving transistor received from the sensing line is stored in the capacitor of the data-sensing circuit in the signal sensing period.

5. The data-sensing circuit of claim 3, wherein the signal sensing period, in which a sensing current is sensed from the pixel circuit, is defined in a power-off period, the switching transistor is turned off in the signal sensing period, the sensing transistor is turned on in the signal sensing period, the sixth and eighth switches are turned on in the signal sensing period, the first, second, third, fourth, fifth and seventh switches are turned off in the signal sensing period, and a sensing signal corresponding a current flowing through the driving transistor received from the sensing line is stored in the capacitor of the data-sensing circuit in the signal sensing period.

6. The data-sensing circuit of claim 3, wherein the signal sensing period, in which a sensing current is sensed from the pixel circuit, is defined in a display period, the switching transistor is turned off in the signal sensing period, the sensing transistor is turned on in the signal sensing period, the second, third, fourth, seventh and eighth switches are turned on in the signal sensing period, the first, fifth and sixth switches are turned off in the signal sensing period, the second input terminal of the amplifier receives a third reference voltage in the signal sensing period, a current flows between the driving transistor, which receives a power source voltage, the sensing line connected to the driving transistor, the amplifier connected to the sensing line and a ground connected to the output terminal of the amplifier in the signal sensing period, and the amplifier and the feedback capacitor are reset in the signal sensing period.

7. The data-sensing circuit of claim 6, wherein the switching transistor is turned off after the amplifier is reset, the sensing transistor is turned on after the amplifier is reset, the second, third, seventh and eighth switches are turned on after the amplifier is reset, the first, fourth, fifth and sixth switches are turned off after the amplifier is reset, a sensing signal corresponding to a current flowing through the driving transistor is applied to the amplifier and the feedback capacitor after the amplifier is reset, and a voltage outputted from the output terminal of the amplifier is stored in the capacitor of the data-sensing circuit after the amplifier is reset.

8. The data-sensing circuit of claim 3, wherein the signal sensing period, in which a sensing voltage is sensed from the pixel circuit, is defined in a display period, the switching transistor is turned on in the signal sensing period, the sensing transistor is turned off in the signal sensing period, the first, third and fourth switches are turned on in the signal sensing period, the second, fifth, sixth, seventh and eighth switches are turned off in the sensing period, the second input terminal of the amplifier receives a third reference voltage in the signal sensing period, the third reference voltage is applied to the control electrode of the driving transistor through the data line in the signal sensing period, and the sensing voltage corresponding to a threshold voltage of the driving transistor is stored in the storage capacitor in the signal sensing period.

9. The data-sensing circuit of claim 8, wherein the switching transistor is turned off after the sensing voltage is stored in the storage capacitor, the sensing transistor is turned on after the sensing voltage is stored in the storage capacitor, the second, third, fourth, seventh and eighth switches are turned on after the sensing voltage is stored in the storage capacitor, the first, fifth and sixth switches are turned off after the sensing voltage is stored in the storage capacitor, the second input terminal of the amplifier receives a fourth reference voltage after the sensing voltage is stored in the storage capacitor, the sensing line is connected to the first input terminal of the amplifier after the sensing voltage is stored in the storage capacitor, the output terminal of the amplifier is connected to the capacitor of the data-sensing circuit after the sensing voltage is stored in the storage capacitor, and the sensing line and the feedback capacitor are initialized through the amplifier after the sensing voltage is stored in the storage capacitor.

10. The data-sensing circuit of claim 9, wherein the switching transistor and the sensing transistor are turned on after the sensing line is initialized, the second, third, seventh and eighth switches are turned on after the sensing line is initialized, and the first, fourth, fifth and sixth switches are turned off after the sensing line is initialized, wherein when the sensing transistor is turned on, the storage capacitor and the feedback capacitor connected to each other through the sensing line are charge-shared with each other and an output voltage of the amplifier is stored in the capacitor of the data-sensing circuit.

11. A data-sensing circuit for a pixel circuit that includes a switching transistor connected to a data line, a storage capacitor connected to the switching transistor, a driving transistor connected to the storage capacitor, an organic light-emitting diode connected to the driving transistor, and a sensing transistor connected between the data line and the driving transistor, the data-sensing circuit comprising:

a first selector connected to the data line;

a second selector connected to an output terminal of an amplifier, the first selector and a feedback capacitor, wherein the second selector selectively connects the output terminal of the amplifier to the first selector and the feedback capacitor;

a third selector connected to the first selector; and a fourth selector connected to the output terminal of the amplifier and the third selector.

12. The data-sensing circuit of claim 11, wherein the second selector comprises:

a third switch connected between the output terminal of the amplifier and the feedback capacitor; and a fourth switch connected between the output terminal and a first input terminal of the amplifier, the first selector comprises:

a first switch connected between the data line and the fourth switch; and a second switch connected between the data line and the third selector, the third selector comprises:

a fifth switch connected between a voltage terminal and the second switch; and a sixth switch connected between the second switch and the fourth selector, and the fourth selector comprises:

a seventh switch connected between the second selector and the sixth switch; and an eighth switch connected between the seventh switch and a capacitor of the data-sensing circuit.

13. The data-sensing circuit of claim 12, wherein a sensing period comprises an initializing period, in which the pixel circuit is initialized, and a signal sensing period, in which a sensing signal formed in the pixel circuit is sensed, wherein in a first period of the initializing period, a second reference voltage is received from a second input terminal of the amplifier, the switching transistor is turned on, the sensing transistor is turned off, the first, third and fourth switches are turned on, the second, fifth, sixth, seventh and eighth switches are turned off, and the second reference voltage is applied to a control electrode of the driving transistor, and in a second period of the initializing period, a voltage terminal receives a first reference voltage, the switching transistor is turned off, the sensing transistor is turned on, the fifth switch is turned on, the first, second, third, fourth, sixth, seventh and eighth switches are turned off, and an electrode of the driving transistor receives the first reference voltage.

14. The data-sensing circuit of claim 12, wherein the signal sensing period, in which a sensing voltage is sensed from the pixel circuit, is defined in a power-off period, in a first period of the signal sensing period, a second input terminal of the amplifier receives a reference voltage, the switching transistor is turned on, the sensing transistor is turned off, the first, third and fourth switches are turned on, the second, fifth, sixth, seventh and eighth switches are turned off, and the driving transistor forms a threshold voltage, and in a second period of the signal sensing period, the switching transistor is turned off, the sensing transistor is turned on, the sixth and eighth switches are turned on, the first, second, third, fourth, fifth and seventh switches are turned off, and a sensing signal corresponding to the threshold voltage of the driving transistor is stored in the capacitor of the data-sensing circuit through the data line.

15. The data-sensing circuit of claim 12, wherein the signal sensing period, in which a sensing current is sensed from the pixel circuit, is defined in a power-off period, the switching transistor is turned off in the signal sensing period, the sensing transistor is turned on in the signal sensing period, the sixth and eighth switches are turned on in the signal sensing period, the first, second, third, fourth, fifth and seventh switches are turned off in the signal sensing period, and a sensing signal corresponding a current flowing through the driving transistor received from the data line is stored in the capacitor of the data-sensing circuit in the signal sensing period.

16. The data-sensing circuit of claim 12, wherein the signal sensing period, in which a sensing current is sensed from the pixel circuit, is defined in a display period, the switching transistor is turned off in the signal sensing period, the sensing transistor is turned on, the first, third, fourth, seventh and eighth switches are turned on in the signal sensing period, the second, fifth and sixth switches are turned off in the signal sensing period, the second input terminal of the amplifier receives a reference voltage in the signal sensing period, a current flows between the driving transistor, which receives a power source voltage, the data line connected to the driving transistor, the amplifier connected to the data line and a ground connected to the output terminal of the amplifier in the signal sensing period, and the amplifier and the feedback capacitor are reset in the signal sensing period.

17. The data-sensing circuit of claim 16, wherein after the amplifier is reset, the switching transistor is turned off, the sensing transistor is turned on, the first, third, seventh and eighth switches are turned on, the second, fourth, fifth and sixth switches are turned off, a sensing signal corresponding to a current flowing through the driving transistor is applied to the amplifier and the feedback capacitor, and a voltage outputted from the output terminal of the amplifier is stored in the capacitor of the data-sensing circuit.

18. The data-sensing circuit of claim 12, wherein the signal sensing period, in which a sensing voltage is sensed from the pixel circuit, is defined in a display period, the switching transistor is turned on in the signal sensing period, the sensing transistor is turned off in the signal sensing period, the first, third and fourth switches are turned on in the signal sensing period, the second, fifth, sixth, seventh and eighth switches are turned off in the signal sensing period, a second input terminal of the amplifier receives a second reference voltage in the signal sensing period, the second reference voltage is applied to the control electrode of the driving transistor through the data line in the signal sensing period, and the sensing voltage corresponding to a threshold voltage of the driving transistor is stored in the storage capacitor in the signal sensing period.

19. The data-sensing circuit of claim 18, wherein the switching transistor is turned off, the sensing transistor is turned on after the sensing voltage is stored in the storage capacitor, the first, third, fourth, seventh and eighth switches are turned on after the sensing voltage is stored in the storage capacitor, the second, fifth and sixth switches are turned off after the sensing voltage is stored in the storage capacitor, a second input terminal of the amplifier receives a third reference voltage after the sensing voltage is stored in the storage capacitor, the data line is connected to a first input terminal of the amplifier after the sensing voltage is stored in the storage capacitor, the output terminal of the amplifier is connected to the capacitor of the data-sensing circuit after the sensing voltage is stored in the storage capacitor, and the data line and the feedback capacitor are initialized through the amplifier after the sensing voltage is stored in the storage capacitor.

20. The data-sensing circuit of claim 19, wherein the switching transistor is turned off after the data line is initialized, the sensing transistor is turned on after the sensing line is initialized, the first, third, seventh and eighth switches are turned on and the second, fourth, fifth and sixth switches turned off after the sensing line is initialized, wherein when the sensing transistor is turned on, the storage capacitor and the feedback capacitor connected to each other through the data line are charge-shared with each other and an output voltage of the amplifier is stored in a capacitor of the data-sensing circuit.

* * * * *